US011608987B1

(12) United States Patent
Blum et al.

(10) Patent No.: US 11,608,987 B1
(45) Date of Patent: Mar. 21, 2023

(54) CONTROL KNOB WITH DISPLAY

(71) Applicant: Sub-Zero Group, Inc., Madison, WI (US)

(72) Inventors: Bronson Blum, Cottage Grove, WI (US); Alexander R. Krahn, Sun Prairie, WI (US); Mark R. Eckert, Verona, WI (US)

(73) Assignee: Sub-Zero Group, Inc., Madison, WI (US)

( * ) Notice: Subject to any disclaimer, the term of this patent is extended or adjusted under 35 U.S.C. 154(b) by 185 days.

(21) Appl. No.: 17/146,538

(22) Filed: Jan. 12, 2021

(51) Int. Cl.
*F24C 7/08* (2006.01)
*F24C 3/12* (2006.01)
*G09F 9/302* (2006.01)

(52) U.S. Cl.
CPC ..... *F24C 7/085* (2013.01); *F24C 3/128* (2013.01); *G09F 9/3023* (2013.01)

(58) Field of Classification Search
CPC ..... F24C 7/082; Y10T 16/506
See application file for complete search history.

(56) References Cited

U.S. PATENT DOCUMENTS 2,682,859 A 7/1954 Jensen et al.
2,699,141 A 1/1955 Gaguski
2,998,733 A 9/1961 Thompson
D194,137 S 11/1962 Jenn
3,087,013 A * 4/1963 Stastny ..... H04N 5/655 D14/125
D266,348 S 9/1982 Piesco
D316,293 S 4/1991 Ragonot
D324,807 S 3/1992 Reid et al.
D369,940 S 5/1996 Wilsdorf
D400,778 S 11/1998 Holbrook
5,936,613 A 8/1999 Jaeger et al.
D419,218 S 1/2000 Mullenmeister
6,079,401 A 6/2000 Alvord et al.
D493,090 S 7/2004 Chen et al.
D498,657 S 11/2004 Milrud et al.
D509,095 S 9/2005 Grutzke et al.
D509,987 S 9/2005 Vetter
D511,290 S 11/2005 Coudurier
D525,517 S 7/2006 Baldwin
D534,628 S 1/2007 Chisenhall
(Continued)

FOREIGN PATENT DOCUMENTS

EP 2659190 9/2014

*Primary Examiner* — Thien S Tran
(74) *Attorney, Agent, or Firm* — Bell & Manning, LLC

(57) ABSTRACT

A control knob includes a control rod assembly including a base plate, a control rod, and an electronic circuit board, a display connected to receive an electrical signal from the electronic circuit board and including a display front face that displays a device status, a knob including a knob aperture wall, and a cover mounted between the knob and the base plate and including a cover sidewall that mounts to the base plate, a cover front wall mounted to the cover sidewall to cover an interior of the cover sidewall, and a display aperture wall formed in a portion of the cover sidewall and a portion of the cover front wall. The display aperture wall allows insertion of the display housing. The control rod assembly, the display, and the cover rotate with the knob when the knob is rotated. The display front face is visible through the knob aperture wall.

20 Claims, 35 Drawing Sheets

(56) References Cited

U.S. PATENT DOCUMENTS

| | | | |
|---|---|---|---|
| 7,171,727 | B2 | 2/2007 | Wylie et al. |
| 7,251,861 | B2 | 8/2007 | Suzuki |
| 7,259,908 | B2 | 8/2007 | Wagener et al. |
| D568,715 | S | 5/2008 | Gustafson et al. |
| 7,381,128 | B2 | 6/2008 | Ogawa et al. |
| D578,890 | S | 10/2008 | Swanson et al. |
| 7,462,795 | B2 | 12/2008 | Montalvo |
| D597,632 | S | 8/2009 | Obara et al. |
| D631,726 | S | 2/2011 | Sanchez |
| D642,042 | S | 7/2011 | Kim |
| D644,912 | S | 9/2011 | Benold |
| D645,702 | S | 9/2011 | Baacke et al. |
| D649,004 | S | 11/2011 | Sanchez |
| 8,430,460 | B2 | 4/2013 | Erro et al. |
| D696,068 | S | 12/2013 | Baacke |
| D697,359 | S | 1/2014 | Meda et al. |
| 8,662,102 | B2 | 3/2014 | Shaffer et al. |
| D704,028 | S | 5/2014 | Meda et al. |
| D724,381 | S | 3/2015 | Pionek et al. |
| D724,382 | S | 3/2015 | Pionek et al. |
| D724,888 | S | 3/2015 | Lee et al. |
| 8,979,289 | B2 | 3/2015 | Camli et al. |
| 9,146,033 | B2 | 9/2015 | Cadima et al. |
| D741,454 | S | 10/2015 | Freier et al. |
| D752,385 | S | 3/2016 | Pionek et al. |
| D752,386 | S | 3/2016 | Pionek et al. |
| D764,028 | S | 8/2016 | Schoenherr et al. |
| D779,262 | S | 2/2017 | Kim et al. |
| D781,126 | S | 3/2017 | Pionek et al. |
| D806,512 | S | 1/2018 | Chow et al. |
| 10,401,035 | B2 | 9/2019 | Pionek et al. |
| D924,660 | S | 7/2021 | Blum et al. |
| 2004/0070574 | A1* | 4/2004 | Wylie ..... F24C 7/082 345/184 |
| 2008/0023309 | A1* | 1/2008 | Montalvo ..... H01H 9/181 200/332 |
| 2014/0047943 | A1 | 2/2014 | Camli et al. |
| 2019/0051468 | A1* | 2/2019 | Turner ..... H01H 19/025 |

* cited by examiner

CONTROL KNOB WITH DISPLAY

BACKGROUND

Control knobs are mounted to various devices to control operation of the device. A display may be mounted to the control knob to convey information related to use of the control knob and its effect on operation of the device. For illustration, the device may be an oven, and the display may convey a current temperature setting for the oven or be unlit if the oven is off.

SUMMARY

In an example embodiment, a control knob is provided. The control knob may include, but is not limited to, a control rod assembly, a display, a knob, and a cover. The control rod assembly is configured to control an operation of a device. The control rod assembly may include, but is not limited to, a base plate, a control rod mounted to the base plate and configured to mount to the device, and an electronic circuit board mounted to the base plate and connected to receive an electrical signal from the control rod. The display is connected to receive an electrical signal from the electronic circuit board. The display may include, but is not limited to, a display housing, and a display front face mounted to the display housing and configured to display a device status when an operation of the device is controlled by the control knob. The knob is mounted to the base plate and may include, but is not limited to, a knob aperture wall. The cover is mounted between the knob and the base plate. The cover may include, but is not limited to, a cover sidewall configured to mount to the base plate, a cover front wall mounted to the cover sidewall to cover an interior of the cover sidewall, and a display aperture wall formed in a portion of the cover sidewall and a portion of the cover front wall. The display aperture wall is configured to allow insertion of the display housing. The control rod assembly, the display, and the cover are configured to rotate with the knob when the knob is rotated. The display front face is visible through the knob aperture wall.

In another example embodiment, a device is provided. The device may include, but is not limited to, a housing, an electronics package, and the control knob electrically connected to the electronics package. The housing may include, but is not limited to, one or more walls. The electronics package is configured to measure a rotation angle of the control knob and to provide selection information based on the measured rotation angle to a control system of the device.

In another example embodiment, an oven is provided. The oven may include, but is not limited to, a housing, a heat source, an electronics package, and the control knob electrically connected to the electronics package. The housing may include, but is not limited to, one or more walls. The heat source is connected to provide heat to an interior of the housing. The electronics package is configured to measure a rotation angle of the control knob and to provide selection information based on the measured rotation angle to a control system of the oven.

Other principal features of the disclosed subject matter will become apparent to those skilled in the art upon review of the following drawings, the detailed description, and the appended claims.

BRIEF DESCRIPTION OF THE DRAWINGS

Illustrative embodiments of the disclosed subject matter will hereafter be described referring to the accompanying drawings, wherein like numerals denote like elements.

DETAILED DESCRIPTION

Figure 1A:
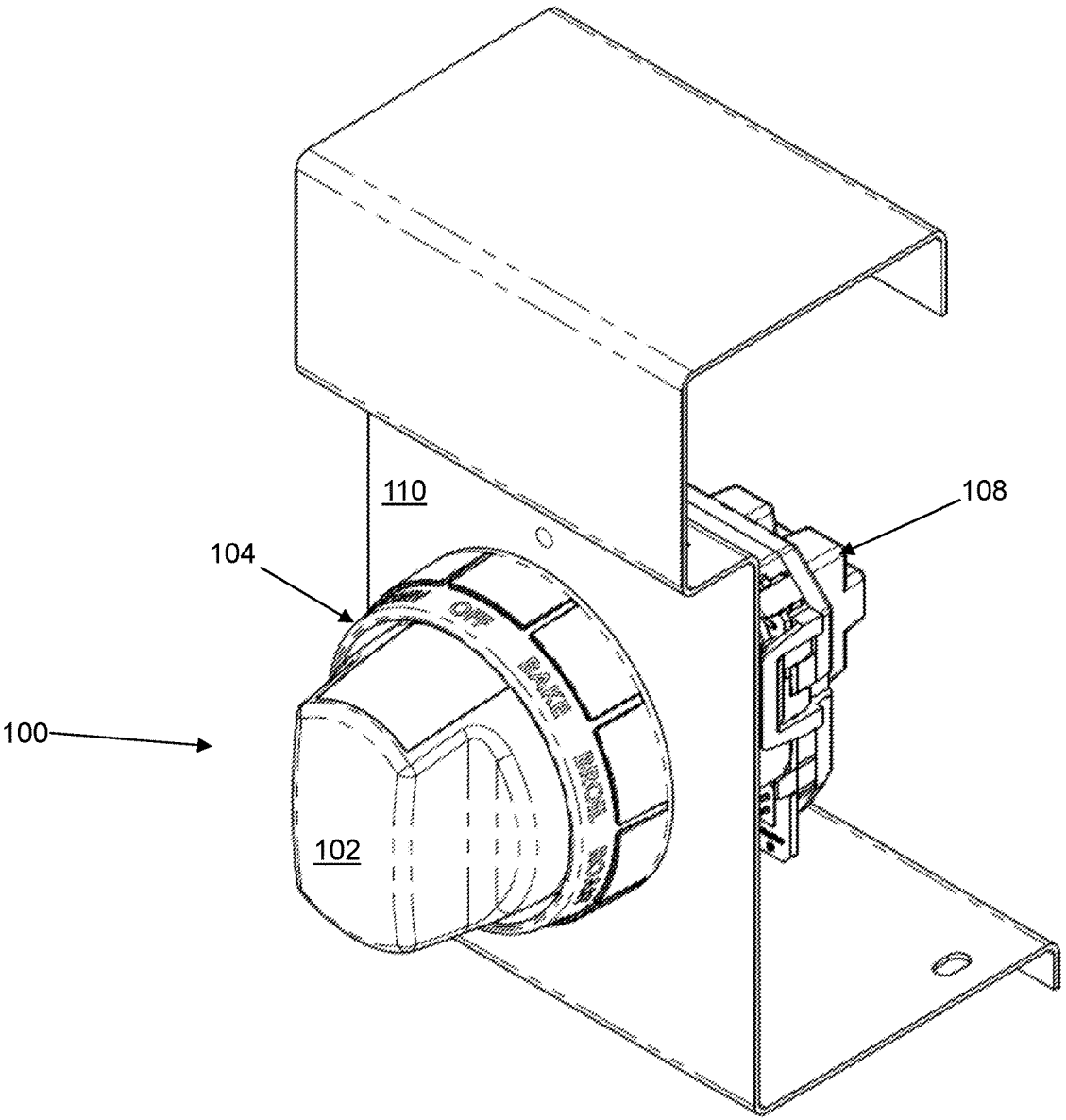
FIG. 1A depicts a front perspective view of a control knob mounted to a device in accordance with an illustrative embodiment.
Figure 1B:
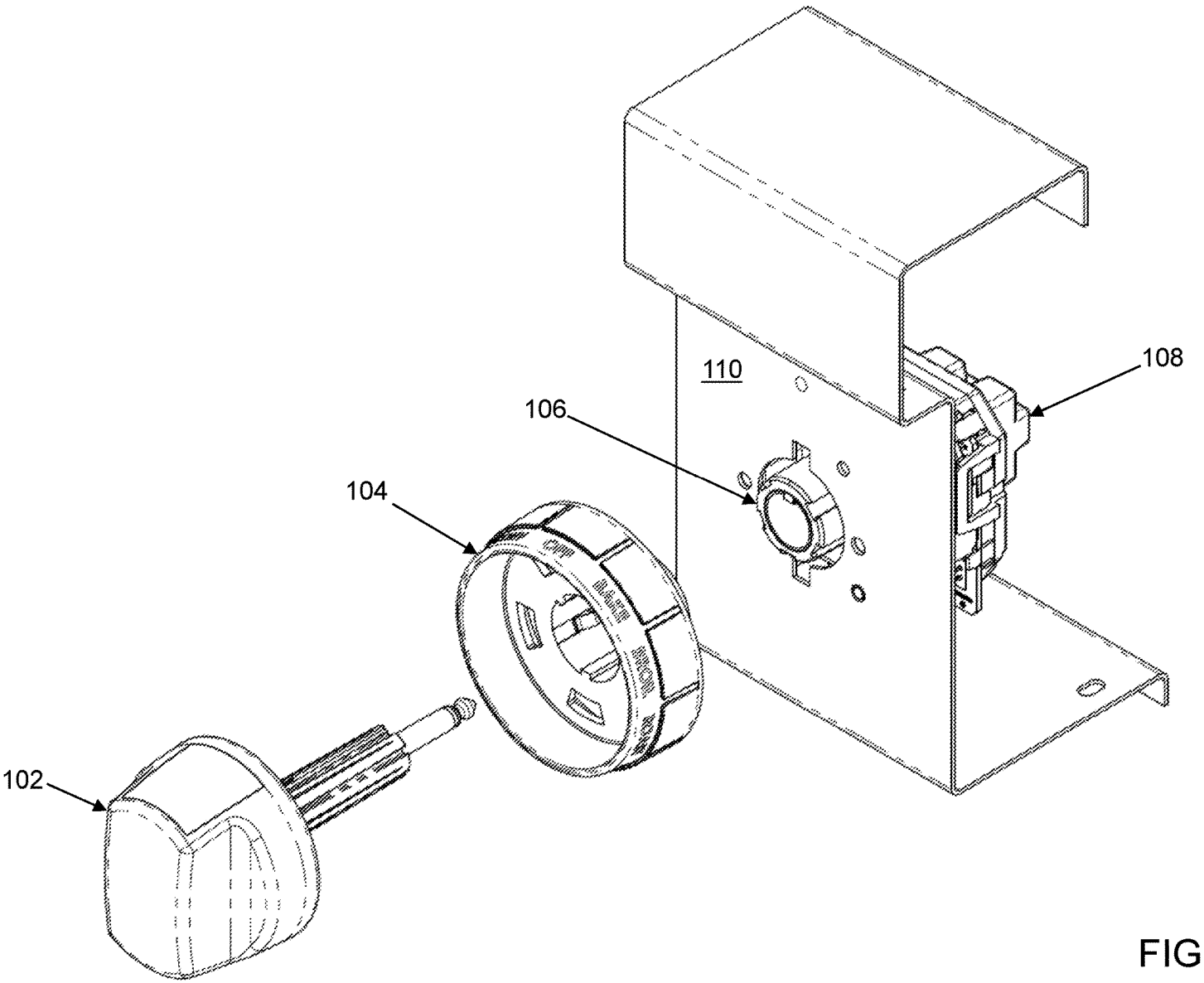
FIG. 1B depicts a front exploded view of the control knob mounted to the device in accordance with an illustrative embodiment.
Figure 1C:
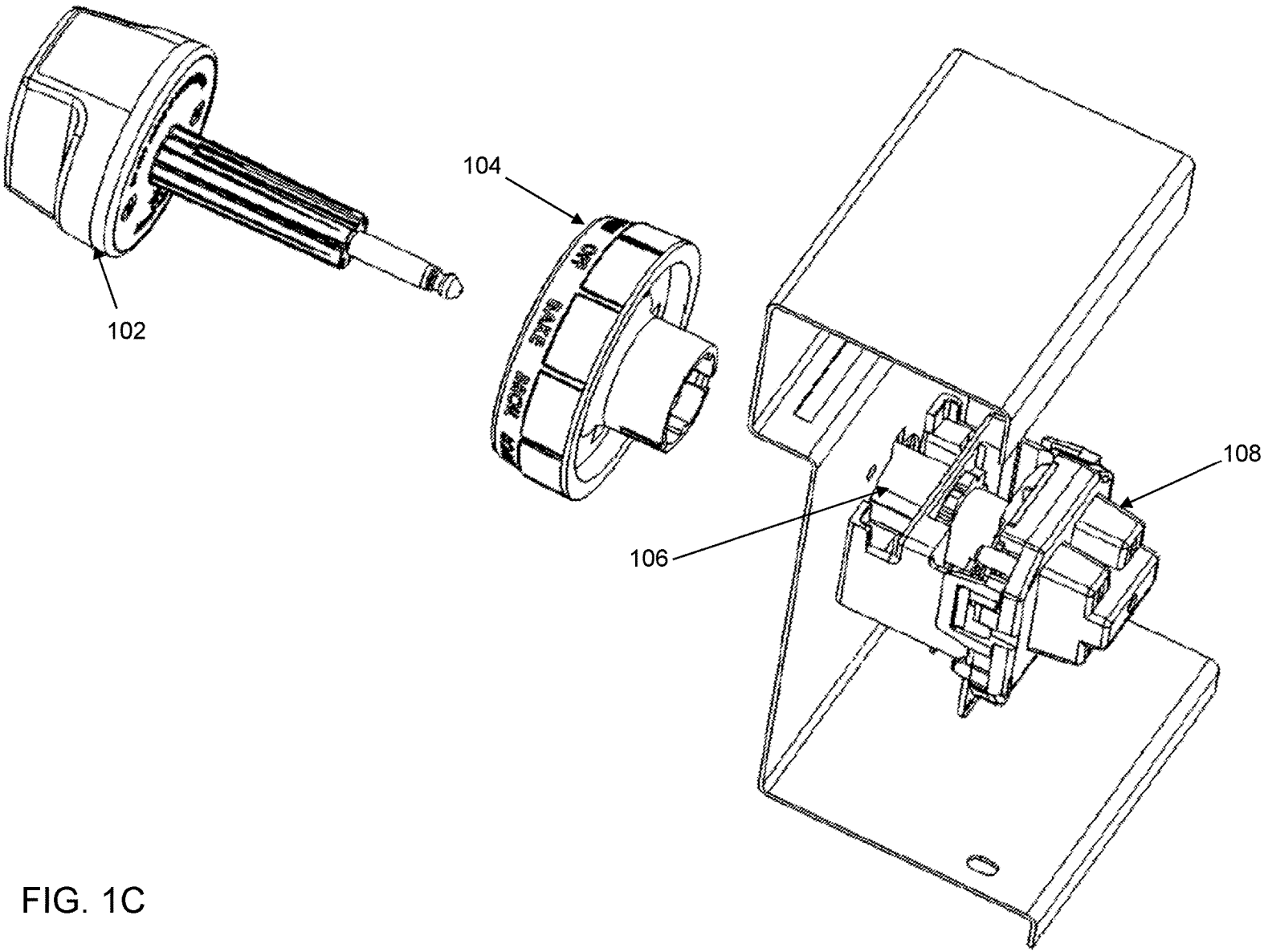
FIG. 1C depicts a back exploded view of the control knob mounted to the device in accordance with an illustrative embodiment.

Referring to FIG. 1A, a top, front perspective view of a control knob assembly 100 is shown in accordance with an illustrative embodiment mounted to a mounting plate 110 of a device to which control knob assembly 100 is mounted to control an operation of the device. Referring to FIG. 1B, a top, front exploded view of control knob assembly 100 is shown in accordance with an illustrative embodiment. Referring to FIG. 1C, a top, back exploded view of control knob assembly 100 is shown in accordance with an illustrative embodiment. For example, the device may be an oven or a range that provides various cooking modes such as bake, roast, clean, broil, convection, warm, sabbath, etc. that may be provided at various temperatures using various types of heat sources. Control knob assembly 100 may be mounted to a control panel of the device in various orientations. Mounting plate 110 may be part of a control panel of the device to which control knob assembly 100 is mounted. In the illustrative embodiment, the device is an oven (not shown).

In the illustrative embodiment, control knob assembly 100 may include a control knob 102, a mode bezel 104, a mounting mechanism 106, and an electronics package 108. Control knob 102 provides one or more selections that may be defined based on a mode selection using mode bezel 104. For example, when a broil cooking mode is selected using mode bezel 104, control knob 102 may present a broil level such as 1, 2, or 3 that can be selected by the user by rotating control knob 102 left or right. When a bake cooking mode is selected using mode bezel 104, control knob 102 may present a temperature in a range from a minimum selectable temperature for the bake mode to a maximum selectable temperature for the bake mode. The temperature can be selected by the user by rotating control knob 102 left or right to increase or decrease the displayed temperature. For example, an initial default temperature may initially be displayed by knob 102, turning the knob to the left decreases the temperature, and turning the knob to the right increases the temperature, or vice versa.

Electronics package 108 measures the selection information from control knob 102 and mode bezel 104 based on a measured rotation angle of control knob 102 and/or mode bezel 104 and provides the selection information to a control system of the device that responds to the selection information from control knob 102 and mode bezel 104. Control knob 102 and mode bezel 104 are mounted to electronics package 108 through mounting mechanism 106. Electronics package 108 is mounted to the device, such as the oven, and electrically connected to the control system of the device. Electronics package 108 may include a control electronic circuit that is electrically connected to the control system of the device. For example, U.S. Pat. No. 7,171,727 describes an illustrative electronics package 108 and mounting mechanism 106.

Figure 2:
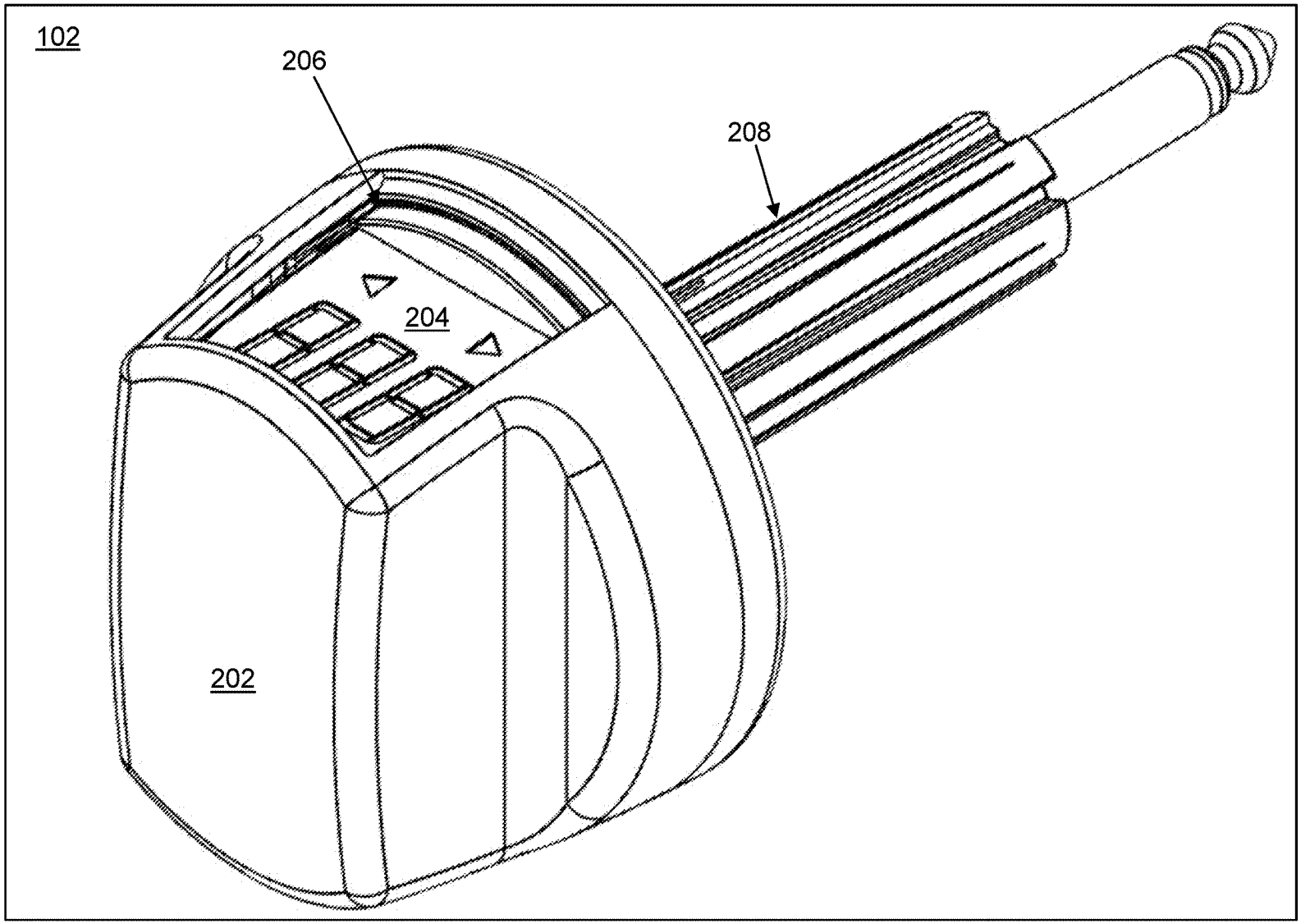
FIG. 2 depicts a front perspective view of the control knob of FIG. 1 in accordance with an illustrative embodiment.
Figure 3:
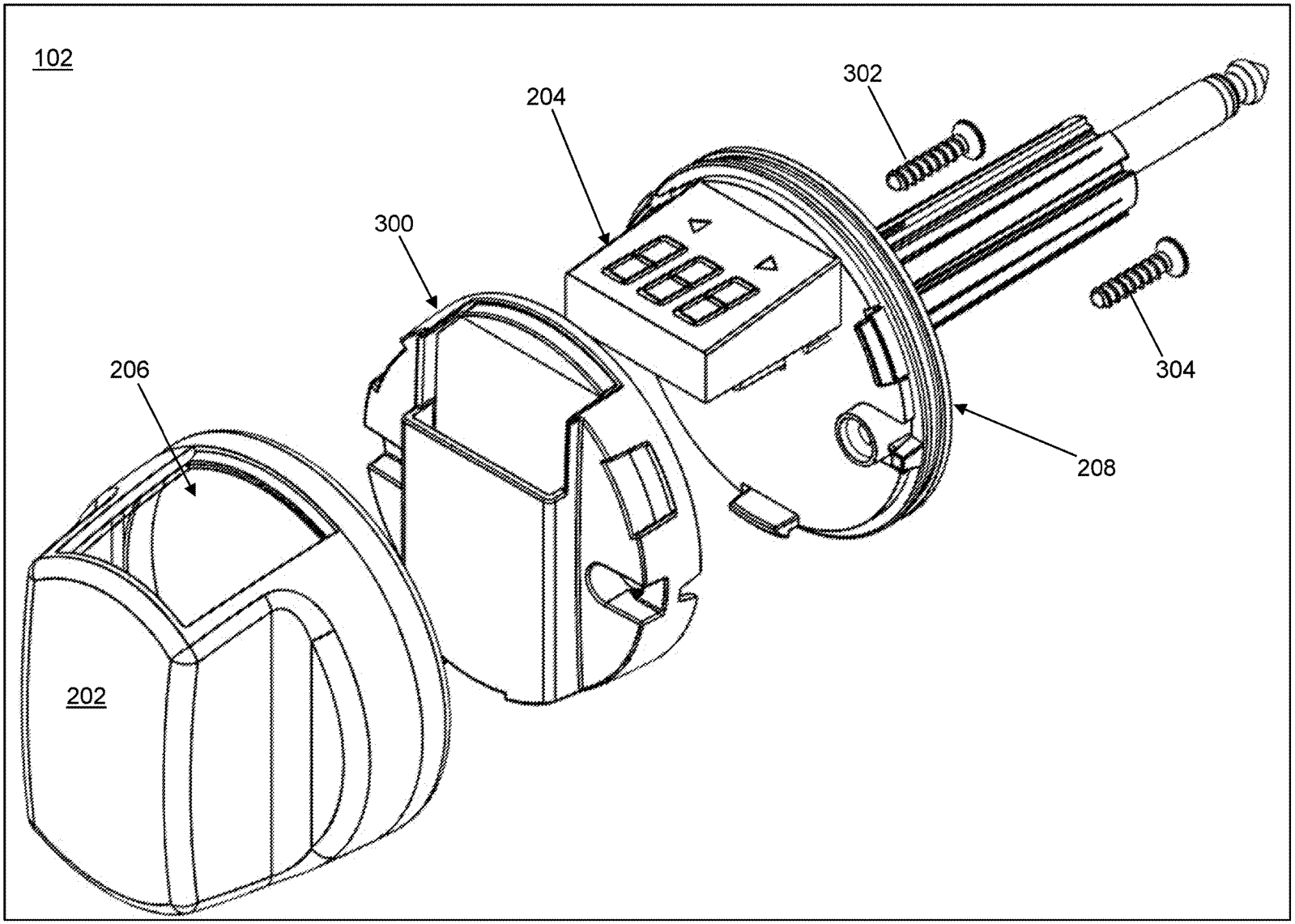
FIG. 3 depicts an exploded, front perspective view of the control knob of FIG. 2 in accordance with an illustrative embodiment.
Figure 5:
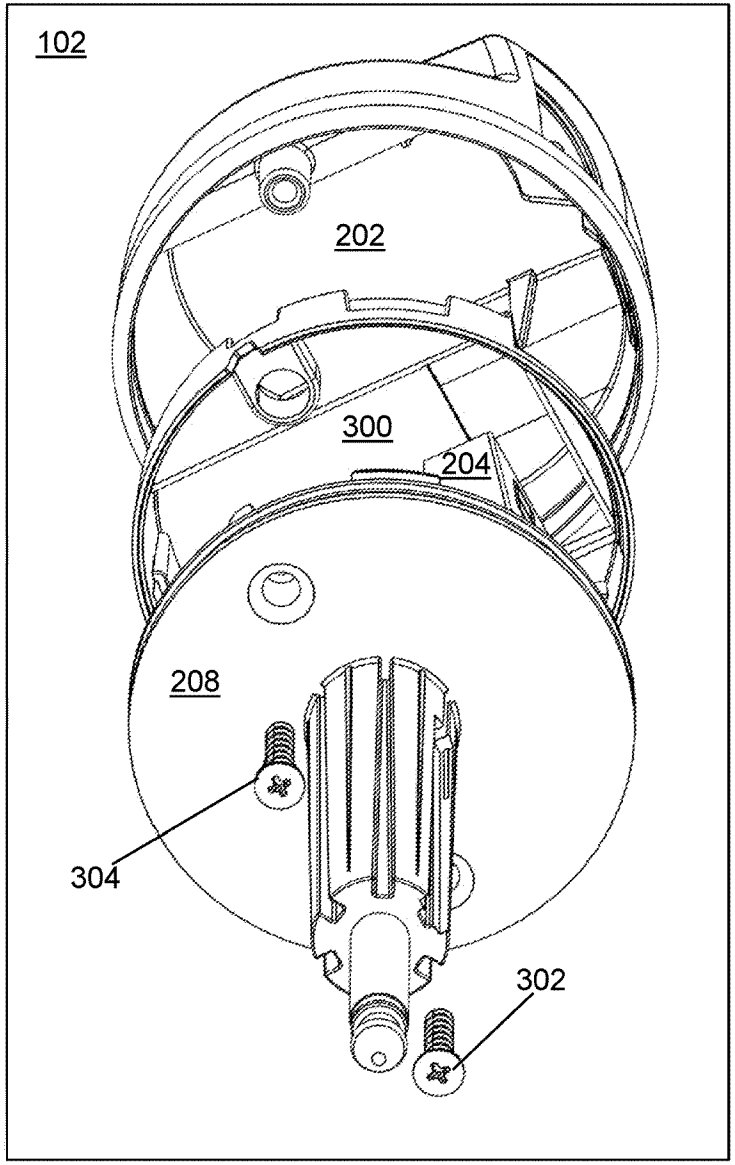
FIG. 5 depicts an exploded, bottom, right perspective view of the control knob of FIG. 2 in accordance with an illustrative embodiment.
Figure 4:
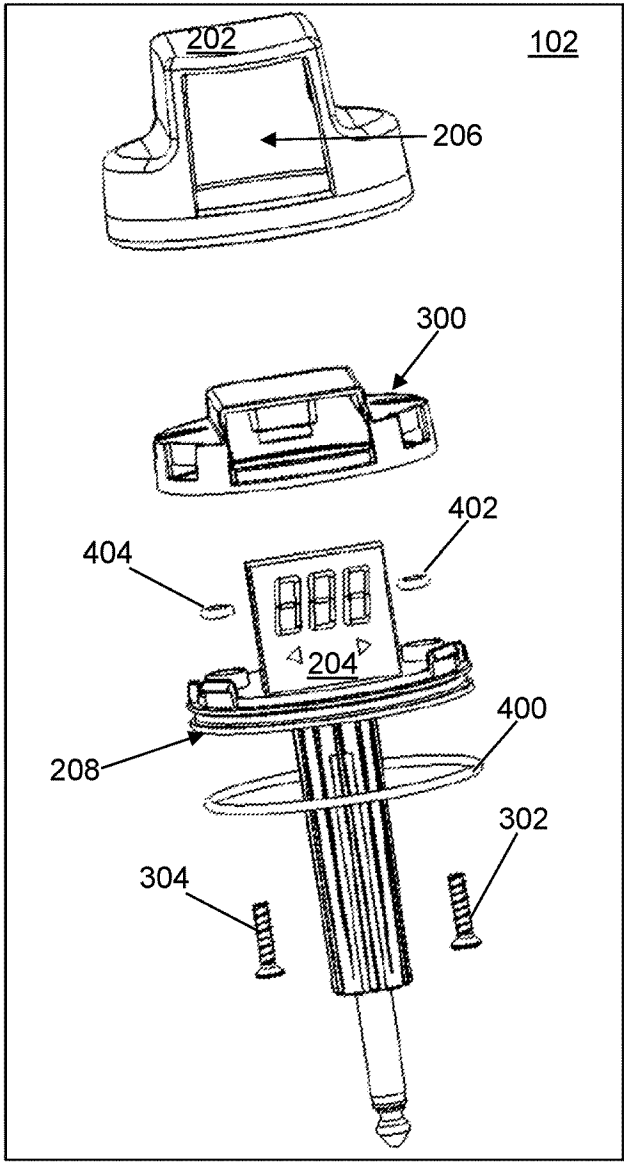
FIG. 4 depicts an exploded, top perspective view of the control knob of FIG. 2 in accordance with an illustrative embodiment.

Control knob 102 may include a knob 202, a display 204, a display cover 206, a cover 300 (shown referring to FIG. 3), a control rod assembly 208, a first fastener 302 (shown referring to FIG. 3), and a second fastener 304 (shown referring to FIG. 3). Referring to FIG. 2, a front perspective view of control knob 102 is shown in accordance with an illustrative embodiment. Referring to FIG. 3, an exploded, front perspective view of control knob 102 is shown in accordance with an illustrative embodiment. Referring to FIG. 4, an exploded, top perspective view of control knob 102 is shown in accordance with an illustrative embodiment. Referring to FIG. 5, an exploded, bottom, right perspective view of control knob 102 is shown in accordance with an illustrative embodiment. Control rod assembly 208 is configured to connect to a socket to provide communication of information between display 204 and the control system of the device to which control knob 102 is mounted. Knob 202 allows a user to control operation of the device by rotating the knob left or right. Display 204 is electrically connected to control rod assembly 208 and integrated with knob 202 to allow the user to view information related to operation of the device. Display cover 206 mounts over an aperture formed in knob 202 to protect display 204. Cover 300 is mounted between knob 202 and control rod assembly 208 to protect control rod assembly 208 from external elements and to refine the position of display 204 via a tightly constrained cutout.

Knob 202 can be removed by a customer for cleaning or to change a color of the knob. For example, knob 202 can be interchanged between a red knob, a black knob, a stainless steel knob, etc. Cover 300 protects the circuit board, display 204, and control rod assembly 208 and keeps the circuit board, display 204, and control rod assembly 208 together as a unit when knob 202 is removed.

In the illustrative embodiment, first fastener 302 and second fastener 304 are screws that include a shaft and a head as understood by a person of skill in the art. A portion of the shafts may be threaded. Other types of fasteners and mounting methods than those shown for illustration may be used to mount knob 202, cover 300, and control rod assembly 208 to each other. Other illustrative fasteners may be a rivet, a bolt, a nail, etc. In alternative embodiments, other methods of fastening may be used such as an adhesive such as glue or tape. A greater or a fewer number of fasteners may be used to mount various elements together in alternative embodiments instead of those shown for illustration. Additionally, different types of fasteners or combinations of fasteners may be used in alternative embodiments instead of those shown for illustration.

An o-ring 400 fits in an o-ring channel 956 (shown referring to FIG. 9A) of a baseplate 900 (shown referring to FIG. 9A) of control rod assembly 208. A first fastener o-ring 402 fits around the shaft of first fastener 302, and a second fastener o-ring 404. First fastener o-ring 402 and second fastener o-ring 404 provide a seal between cover 300 and control rod assembly 208.

Figure 6B:
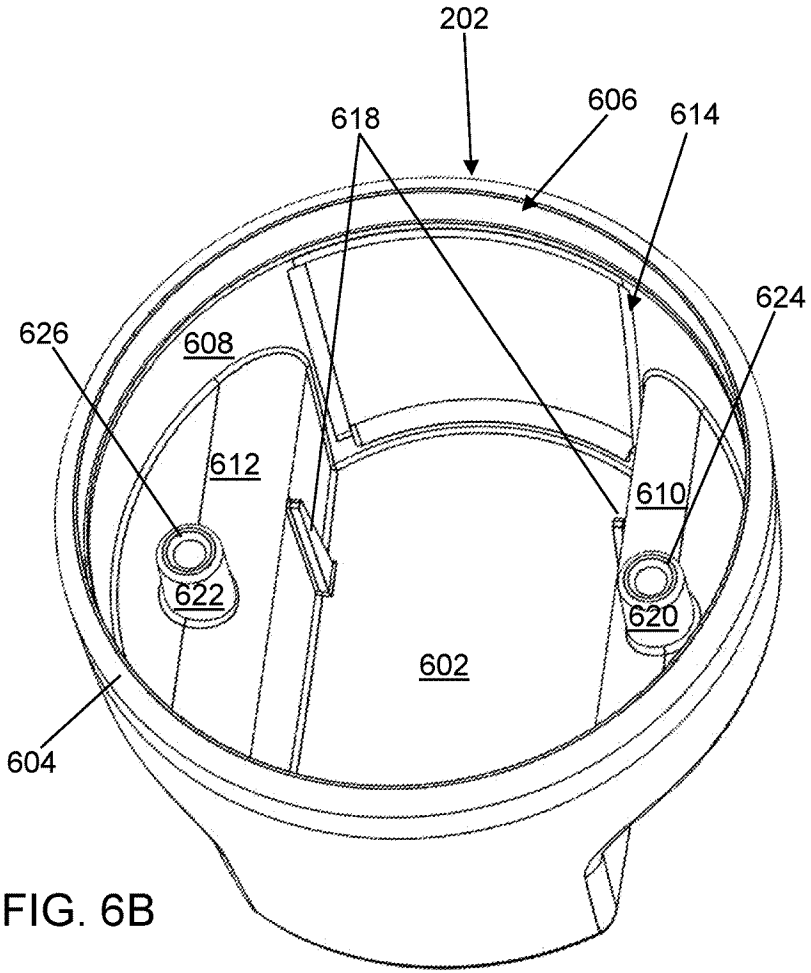
FIG. 6B depicts a bottom perspective view of the knob of FIG. 6A in accordance with an illustrative embodiment.
Figure 6A:
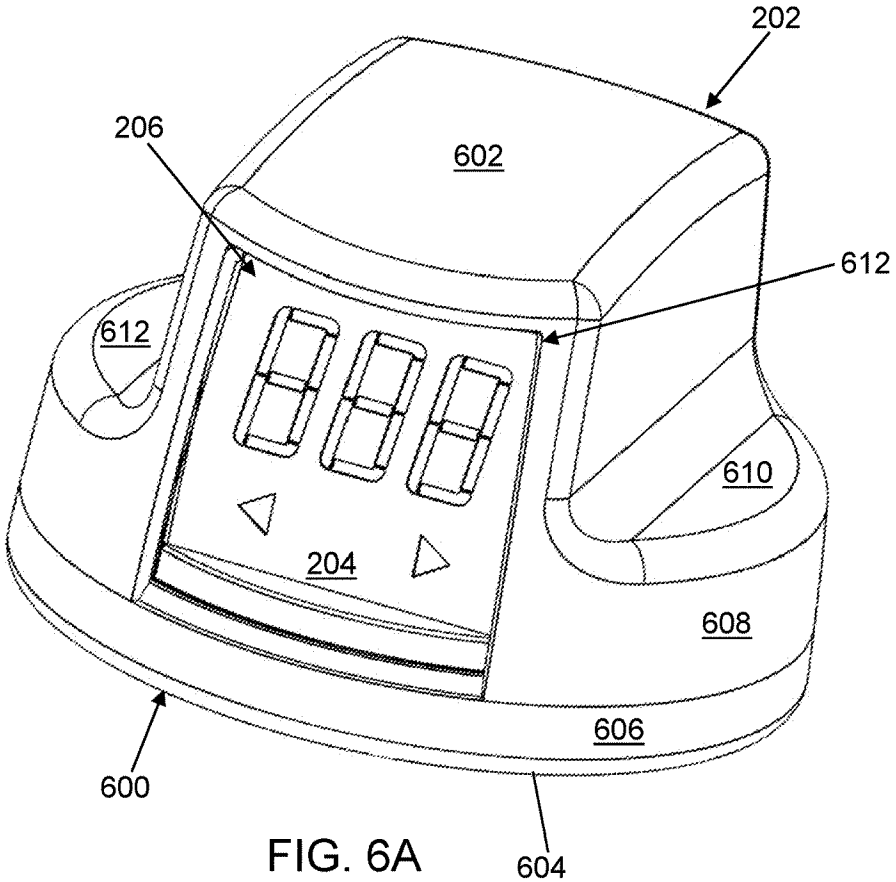
FIG. 6A depicts a top perspective view of a knob, a display, and a display cover of the control knob of FIG. 2 with a display in accordance with an illustrative embodiment.
Figure 6C:
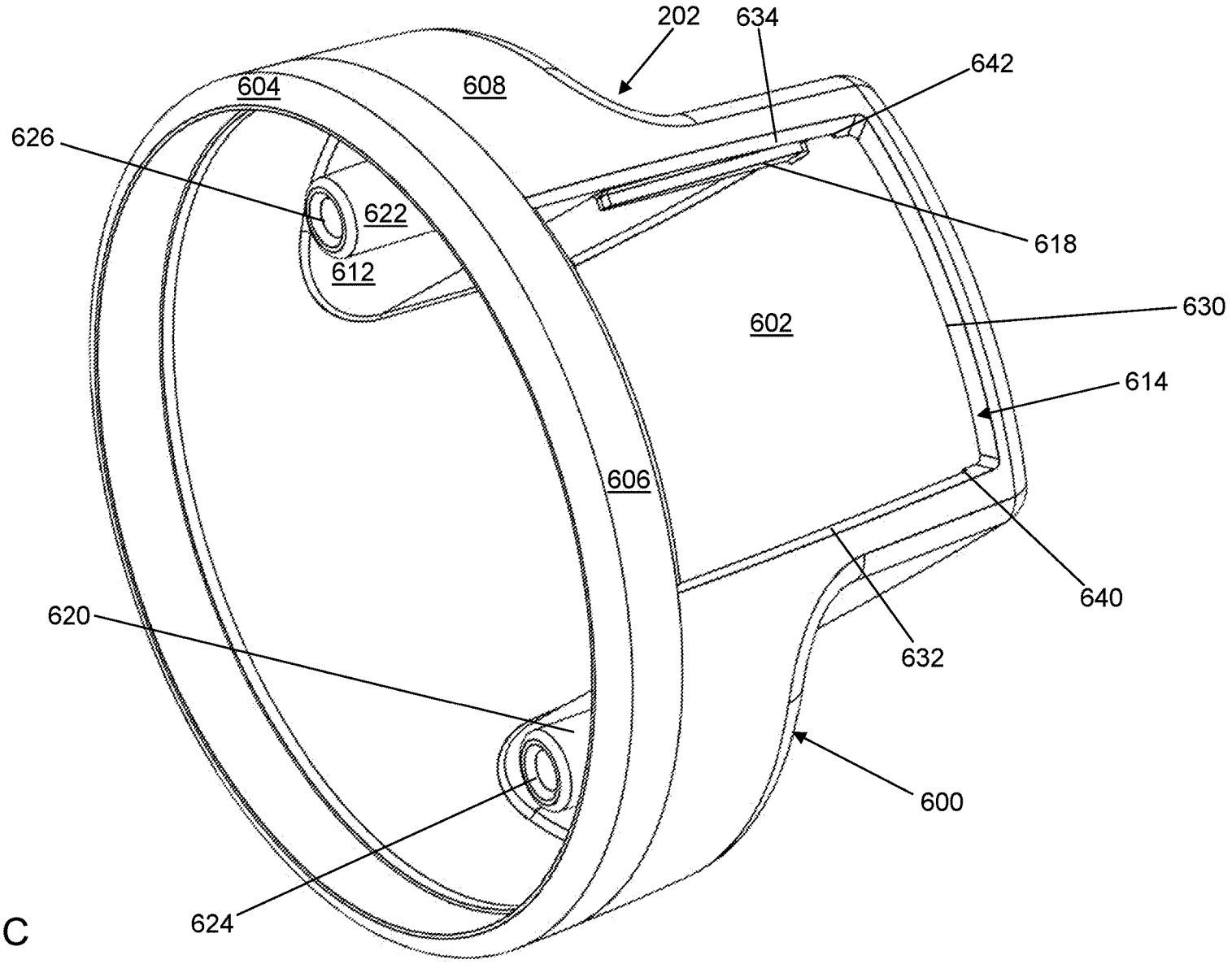
FIG. 6C depicts a top perspective view of the knob of FIG. 6A in accordance with an illustrative embodiment.
Figure 6D:
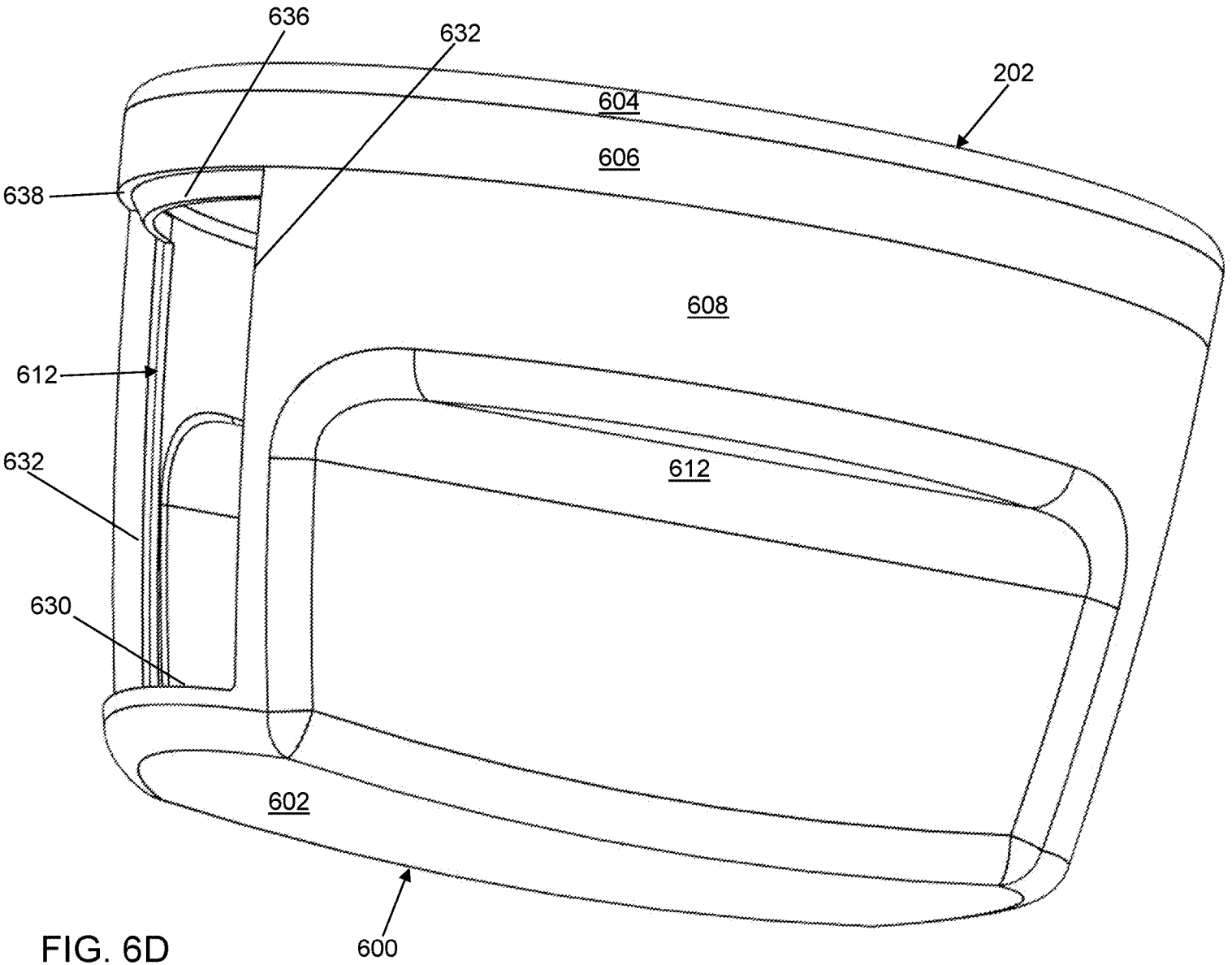
FIG. 6D depicts a right perspective view of the knob of FIG. 6A in accordance with an illustrative embodiment.
Figure 6F:
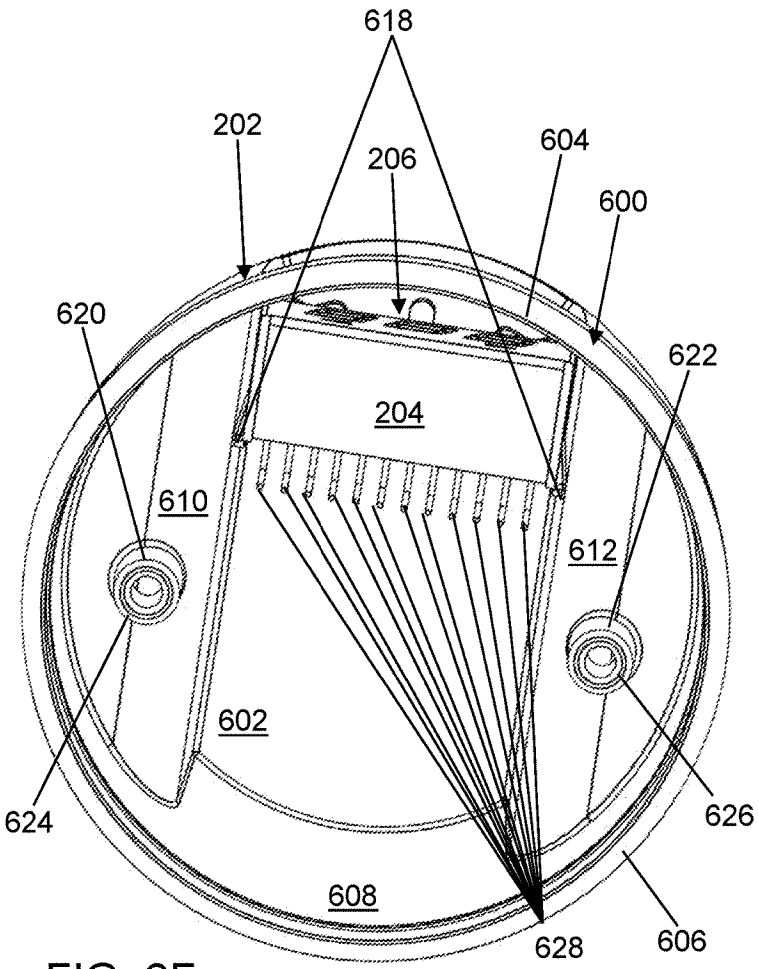
FIG. 6F depicts a bottom perspective view of the knob, the display, and the display cover of FIG. 6A in accordance with an illustrative embodiment.
Figure 6E:
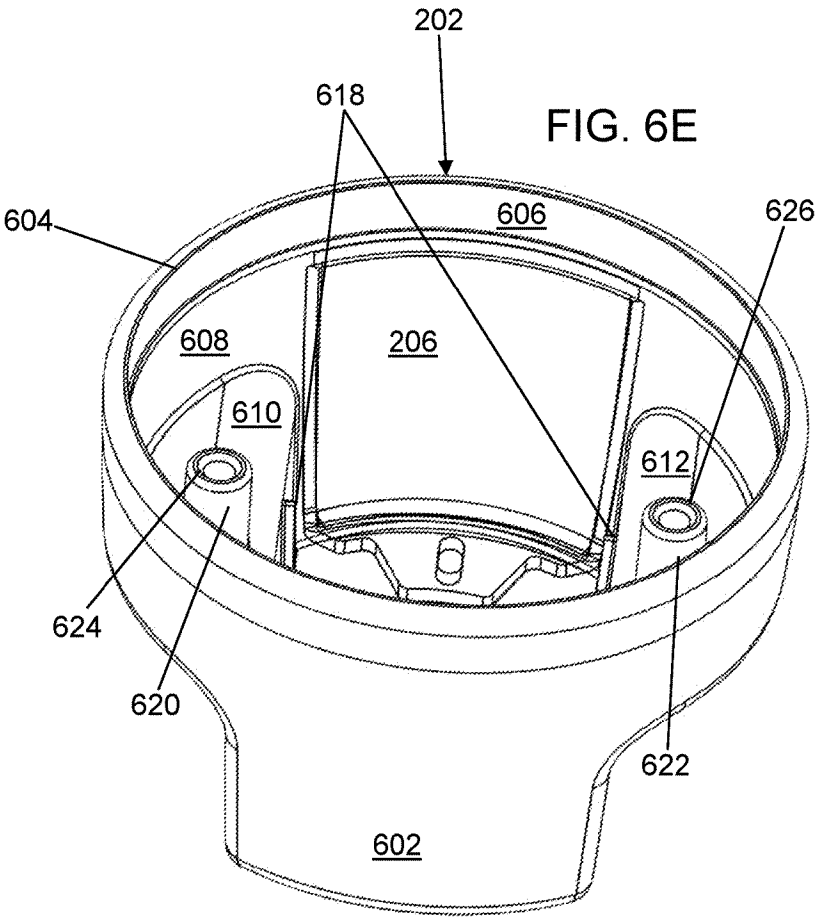
FIG. 6E depicts a bottom, back perspective view of the knob and the display cover of FIG. 6A in accordance with an illustrative embodiment.

Referring to FIG. 6A, a top perspective view of knob 202, display 204, and display cover 206 of control knob 102 is shown in accordance with an illustrative embodiment. Referring to FIG. 6B, a bottom perspective view of knob 202 is shown in accordance with an illustrative embodiment. Referring to FIG. 6C, a top perspective view of knob 202 is shown in accordance with an illustrative embodiment. Referring to FIG. 6D, a right perspective view of knob 202 is shown in accordance with an illustrative embodiment. Referring to FIG. 6E, a bottom, back perspective view of knob 202 and display cover 206 is shown in accordance with an illustrative embodiment. Referring to FIG. 6F, a bottom perspective view of knob 202, display 204, and display cover 206 is shown in accordance with an illustrative embodiment.

Knob 202 may include a knob exterior surface 600 that may include a knob rib 602, a circumferential ring wall 604, a first knob ring wall 606, a second knob ring wall 608, a left knob platform wall 610, and a right knob platform wall 612. Knob exterior surface 600 is visible to a user when knob 202 is mounted for use, for example, to mounting plate 110 of oven 120. For simplicity of description, knob rib 602, circumferential ring wall 604, first knob ring wall 606, second knob ring wall 608, left knob platform wall 610, and right knob platform wall 612 are used to describe a general shape of knob exterior surface 600 though they may not be distinct elements, but may form a single continuous wall. Knob 202 may be formed of various materials including plastic. For example, knob 202 may be formed using a molding process. A shape of knob exterior surface 600 may be designed to provide a handle that the user can grasp to rotate knob 202. For example, knob 202 includes knob rib 602 for ease of rotation. The shape of knob exterior surface 600 further may be designed to provide an aesthetically pleasing appearance to the user.

Circumferential ring wall 604, first knob ring wall 606, and second knob ring wall 608 have a circular shape though other shapes may be used in alternative embodiments. Circumferential ring wall 604 may be positioned closest to and adjacent mounting plate 110 when knob 202 is mounted to the device. First knob ring wall 606 extends between circumferential ring wall 604 and second knob ring wall 608. In the illustrative embodiment, circumferential ring wall 604 has a smaller diameter than first knob ring wall 606, and first knob ring wall 606, and second knob ring wall 608 have a continuously decreasing diameter towards left knob platform wall 610 and right knob platform wall 612.

Left knob platform wall 610 and right knob platform wall 612 extend in a generally perpendicular direction from opposite edges of second knob ring wall 608. Knob rib 602 extends in a generally perpendicular direction from left knob platform wall 610 and right knob platform wall 612 and elsewhere extends continuously from second knob ring wall 608 to form a central rib that extends vertically across knob 202 when knob 202 is in a normal operating position.

A knob lens aperture wall 614 defines an aperture formed through second knob ring wall 608 and a top portion of knob rib 602 outward from an edge of first knob ring wall 606. In the illustrative embodiment, knob lens aperture wall 614 generally defines a rectangular aperture with sides curved similar to a curvature of second knob ring wall 608 and the top portion of knob rib 602 in the respective direction. For example, knob lens aperture wall 614 may include a front curved wall 630, a left sidewall 632, a right sidewall 634, a bottom lens curved wall 636, and a top lens curved shelf 638. Bottom lens curved wall 636 is interior of top lens curved shelf 638 and together define a back curved wall of knob lens aperture wall 614. A left sidewall shelf 640 is formed in left sidewall 632, and a right sidewall shelf 642 is formed in right sidewall 634. Knob lens aperture wall 614 is sized and shaped to hold display cover 206 in position relative to knob 202.

Display 204 is aligned with knob lens aperture wall 614 when mounted to knob 202 so that display 204 is visible to a user. Rotation of knob 202 may be limited, for example, to plus or minus 30 degrees, so that display 204 is not hidden when knob 202 is rotated. Rotation of knob 202 may be spring-loaded so that knob 202 returns to its nominal centered position after movement by the user. The rotation limit may not be applied in some embodiments or may be limited to angles greater than or less than 30 degrees.

An interior surface of knob 202 may include display guide legs 618, a first knob fastener aperture wall 620, a second knob fastener aperture wall 622, a first fastener shaft aperture wall 624, and a second fastener shaft aperture wall 626. Display guide legs 618 are a pair of legs that have a triangular shape that extends inward from an interior surface of a front portion of knob rib 602 along the sidewall of knob rib 602. When display 204 is mounted to knob 202, a back wall 1106 (shown referring to FIG. 11) of a display housing 1100 (shown referring to FIG. 11) of display 204 slides along each leg of the display guide legs 618 to properly position display 204 and hold it in place relative to knob 202.

In the illustrative embodiment, first knob fastener aperture wall 620 and second knob fastener aperture wall 622 extend from left knob platform wall 610 and right knob platform wall 612, respectively. In the illustrative embodiment, first knob fastener aperture wall 620 and second knob fastener aperture wall 622 are positioned approximately in a center of left knob platform wall 610 and right knob platform wall 612, respectively, though other locations may be selected in alternative embodiments. First knob fastener aperture wall 620 and second knob fastener aperture wall 622 may each have a conical shape. First fastener shaft aperture wall 624 is formed across an end of first knob fastener aperture wall 620 opposite left knob platform wall 610. First fastener shaft aperture wall 624 defines an aperture sized and shaped to accept the shaft of first fastener 302. Second fastener shaft aperture wall 626 is formed across an end of second knob fastener aperture wall 622 opposite right knob platform wall 612. Second fastener shaft aperture wall 626 defines an aperture sized and shaped to accept the shaft of second fastener 304.

Figure 7B:
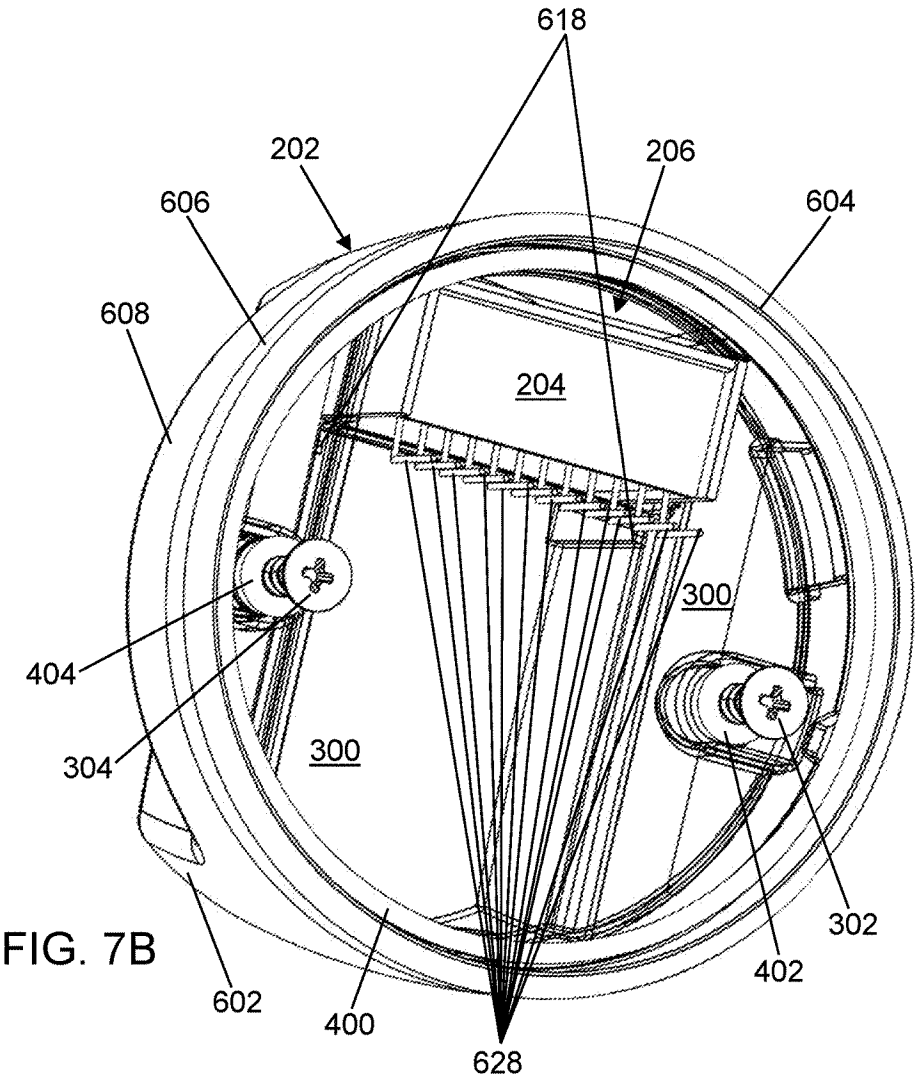
FIG. 7B depicts a bottom perspective view of the knob, the display, and the display cover of FIG. 6A with the o-ring and fasteners in accordance with an illustrative embodiment.
Figure 7A:
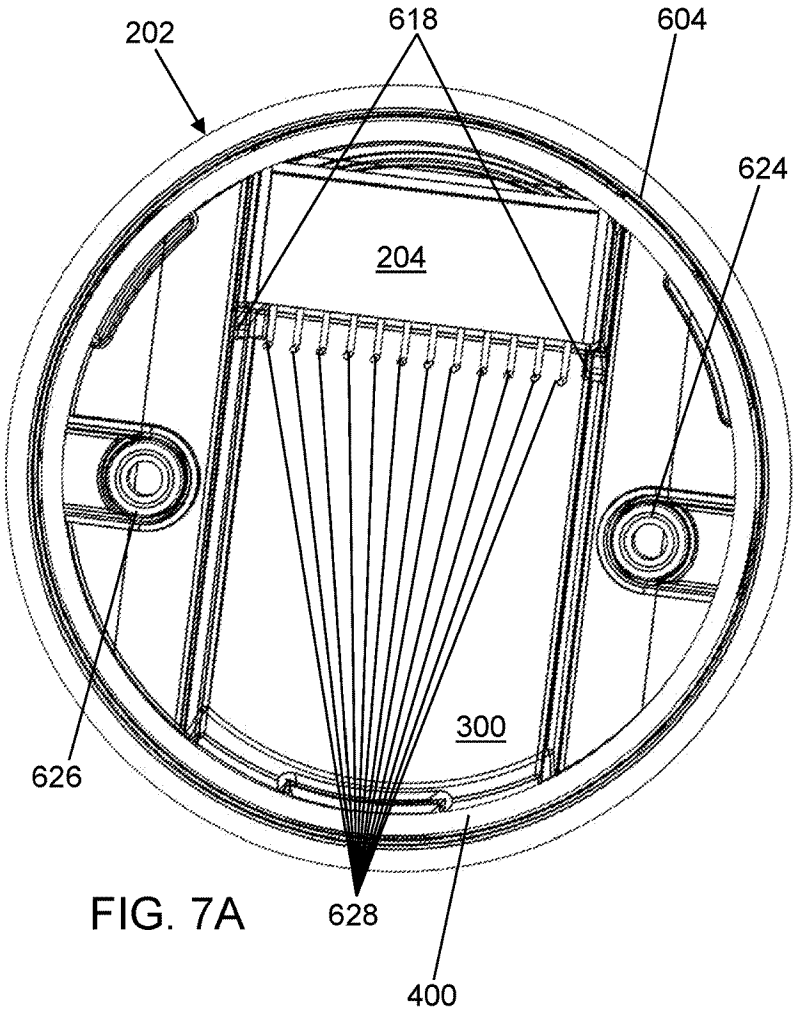
FIG. 7A depicts a bottom view of the knob, the display, and the display cover of FIG. 6A with an o-ring in accordance with an illustrative embodiment.

Referring to FIG. 7A, a bottom view of knob 202, display 204, and display cover 206 is shown in accordance with an illustrative embodiment. Referring to FIG. 7B, a bottom perspective view of knob 202, display 204, and display cover 206 is shown in accordance with an illustrative embodiment.

Figure 8B:
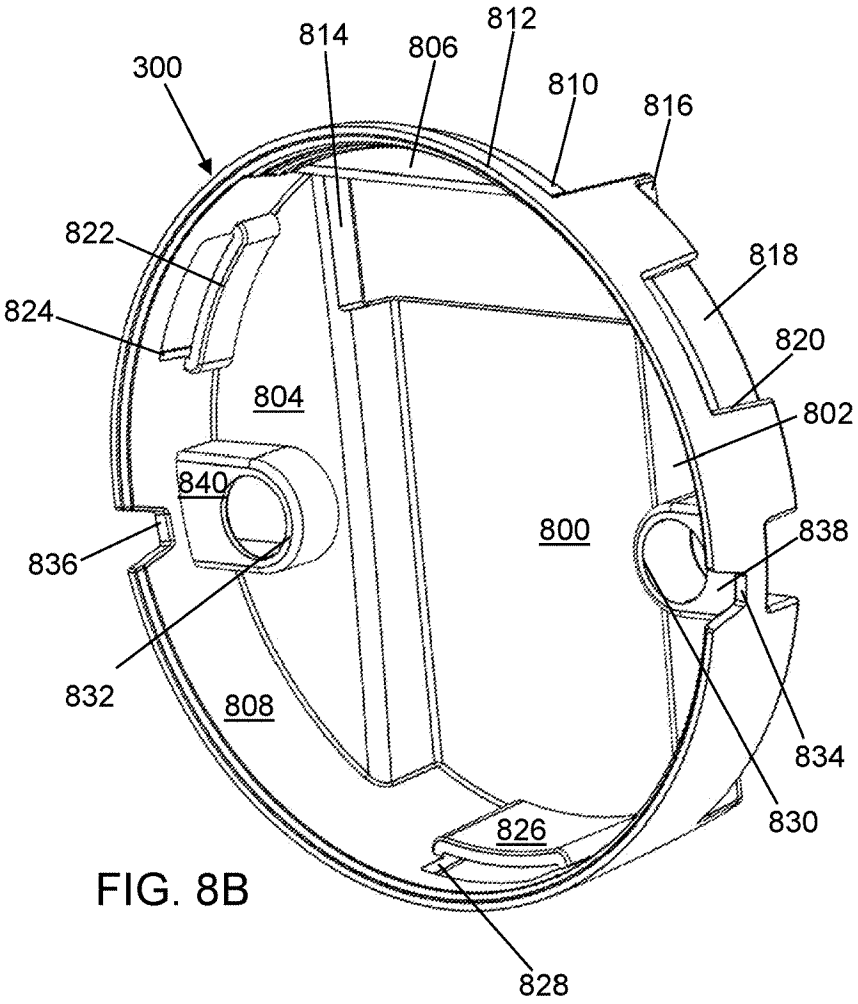
FIG. 8B depicts a back perspective view of the cover of FIG. 8A in accordance with an illustrative embodiment.
Figure 8A:
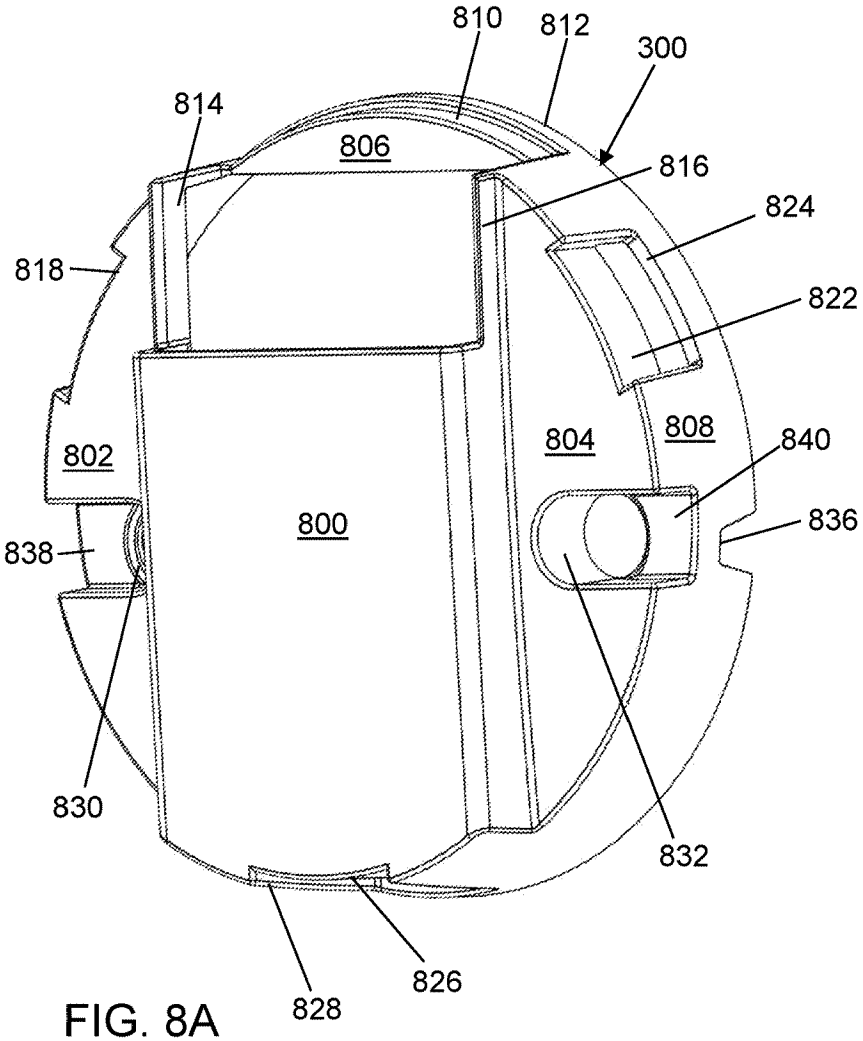
FIG. 8A depicts a front perspective view of a cover of the control knob of FIG. 2 in accordance with an illustrative embodiment.
Figure 8C:
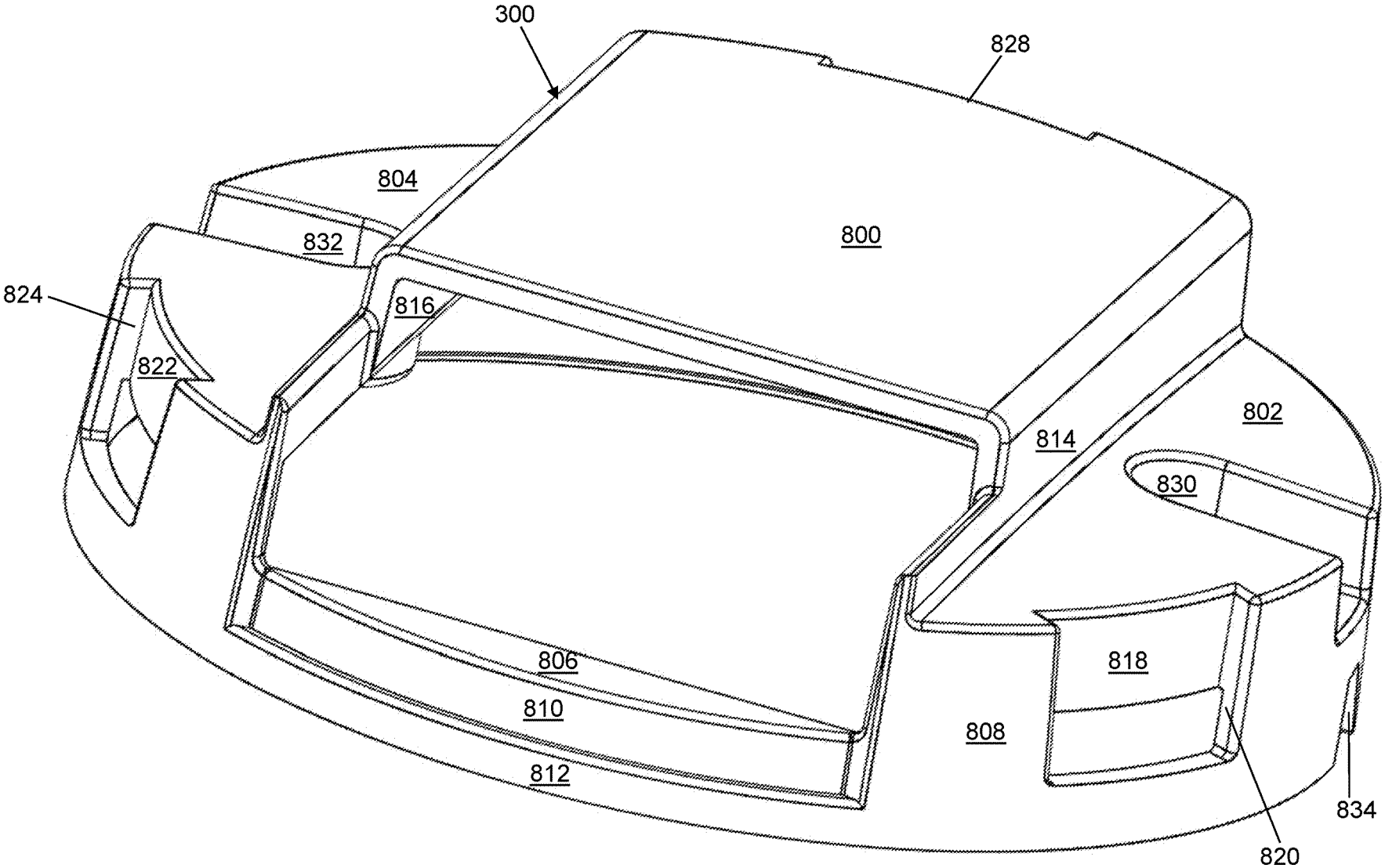
FIG. 8C depicts a top perspective view of the cover of FIG. 8A in accordance with an illustrative embodiment.
Figure 8D:
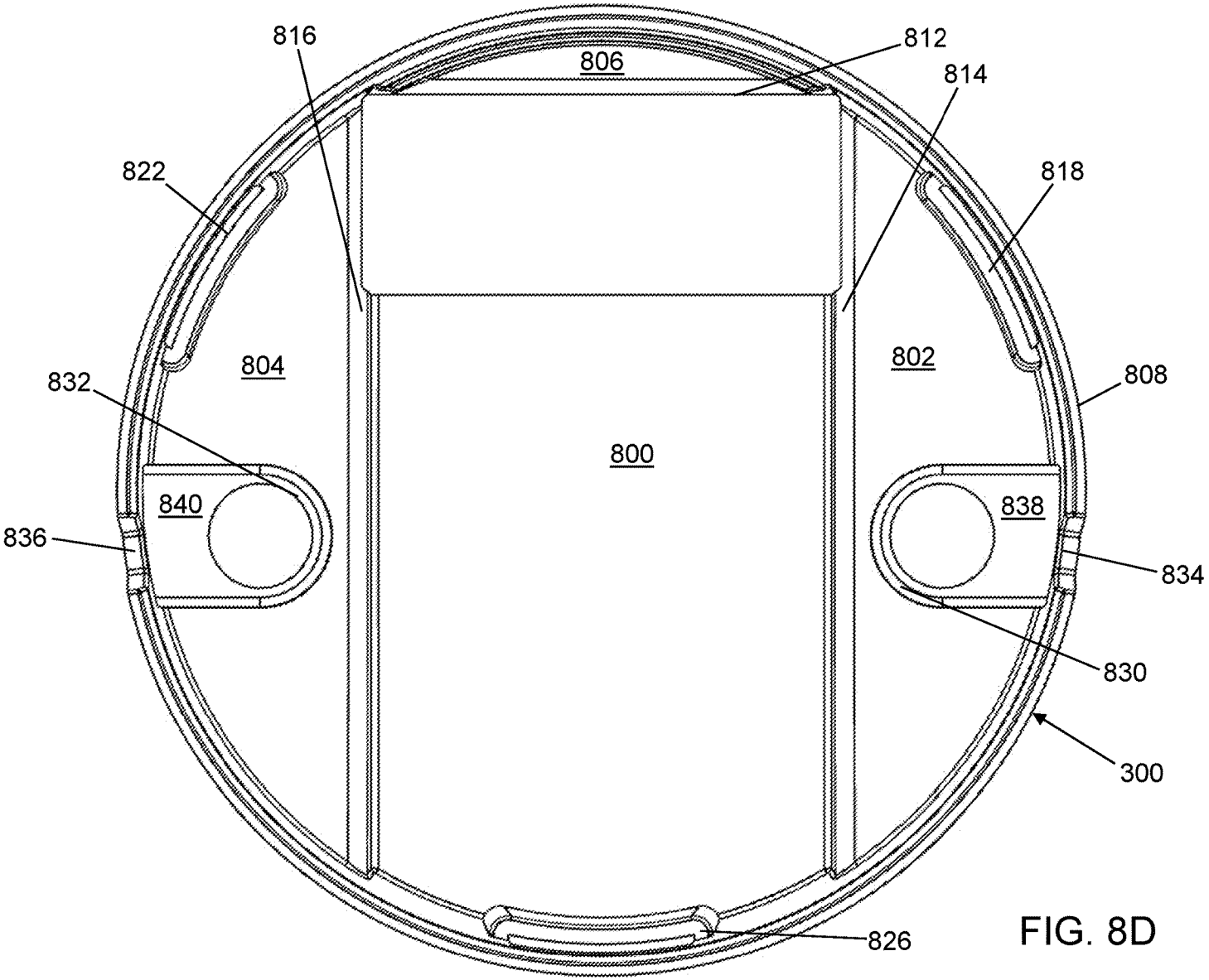
FIG. 8D depicts a back view of the cover of FIG. 8A in accordance with an illustrative embodiment.

Referring to FIG. 8A, a front perspective view of cover 300 is shown in accordance with an illustrative embodiment. Referring to FIG. 8B, a back perspective view of cover 300 is shown in accordance with an illustrative embodiment. Referring to FIG. 8C, a top perspective view of cover 300 is shown in accordance with an illustrative embodiment. Referring to FIG. 8D, a back view of cover 300 is shown in accordance with an illustrative embodiment.

Cover 300 may include a center cover front wall 800, a left cover front wall 802, a right cover front wall 804, a display abutment wall 806, a cover sidewall 808, a bottom lens abutment wall 810, a top lens abutment wall 812, a left side abutment wall 814, a right side abutment wall 816, a first tab wall 818, a first tab aperture wall 820, a second tab wall 822, a second tab aperture wall 824, a third tab wall 826, a third tab aperture wall 828, a first cover fastener aperture wall 830, a second cover fastener aperture wall 832, a left alignment aperture wall 834, a right alignment aperture wall 836, a left mounting wall 838, and a right mounting wall 840. Cover 300 may have a similar size and shape to knob 202. Cover 300 may be formed of various materials including plastic. For example, cover 300 may be formed using a molding process.

For example, left side abutment wall 814 and right side abutment wall 816 extend in a generally perpendicular direction from center cover front wall 800 that may have a similar width to knob rib 602. Left cover front wall 802 extends in a generally perpendicular direction from left side abutment wall 814 and may have a similar width to left knob platform wall 610. Right cover front wall 804 extends in a generally perpendicular direction from right side abutment wall 816 and may have a similar width to right knob platform wall 612. Cover sidewall 808 has a similar shape as circumferential ring wall 604, first knob ring wall 606, and second knob ring wall 608 though smaller in diameter so that it can be inserted within circumferential ring wall 604, first knob ring wall 606, and second knob ring wall 608.

A display aperture is formed in cover sidewall 808 that aligns with the aperture formed by knob lens aperture wall 614. The display aperture of cover 300 may be defined in cover sidewall 808 above display abutment wall 806 and through center cover front wall 800 between left side abutment wall 814 and right side abutment wall 816. Top lens abutment wall 812 is a portion of cover sidewall 808 below bottom lens abutment wall 810. Bottom lens abutment wall 810 extends parallel and inward from top lens abutment wall 812. Display abutment wall 806 extends in a generally perpendicular direction inward from bottom lens abutment wall 810. Display abutment wall 806 may be sized and shaped to generally abut an edge of a display front face 1102 (shown referring to FIG. 11A) of display 204. Notches formed in left side abutment wall 814 and right side abutment wall 816 may be located to allow insertion of display 204 through a portion of center cover front wall 800.

First tab wall 818 and first tab aperture wall 820 define a first tab receiving structure. For example, first tab aperture wall 820 defines an aperture cut in cover sidewall 808. First tab wall 818 is formed across first tab aperture wall 820 above a first tab head aperture defined by first tab aperture wall 820. First tab wall 818 and first tab aperture wall 820 are positioned to align with a first tab 912 (shown referring to FIG. 9A) of base plate 900.

Second tab wall 822 and second tab aperture wall 824 define a second tab receiving structure. For example, second tab aperture wall 824 defines an aperture cut in cover sidewall 808. Second tab wall 822 is formed across second tab aperture wall 820 above a second tab head aperture defined by second tab aperture wall 824. Second tab wall 822 and second tab aperture wall 824 are positioned to align with a second tab 914 (shown referring to FIG. 9A) of base plate 900.

Third tab wall 826 and third tab aperture wall 828 define a third tab receiving structure. For example, third tab aperture wall 828 defines an aperture cut in cover sidewall 808. Third tab wall 826 is formed across third tab aperture wall 820 above a third tab head aperture defined by third tab aperture wall 828. Third tab wall 826 and third tab aperture wall 828 are positioned to align with a third tab 916 (shown referring to FIG. 9A) of base plate 900.

A first U-shaped cavity is formed in left cover front wall 802, and a first Π-shaped cavity is formed in cover sidewall 808. Left mounting wall 838 extends in a generally perpendicular direction inward from cover sidewall 808 to form a base of the Π-shaped cavity. First cover fastener aperture wall 830 is formed through left mounting wall 838 and may be sized, shaped, and positioned to allow insertion of the shaft of first fastener 302. The first U-shaped cavity surrounds a portion of first cover fastener aperture wall 830 and may be sized, shaped and positioned to allow insertion of first knob fastener aperture wall 620 therein.

A second U-shaped cavity is formed in right cover front wall 804, and a second Π-shaped cavity is formed in cover sidewall 808. Right mounting wall 840 extends in a generally perpendicular direction inward from cover sidewall 808 to form a base of the second Π-shaped cavity. Second cover fastener aperture wall 832 is formed through right mounting wall 840 and may be sized, shaped, and positioned to allow insertion of the shaft of second fastener 304. The second U-shaped cavity surrounds a portion of second cover fastener aperture wall 832 and may be sized, shaped and positioned to allow insertion of second knob fastener aperture wall 622 therein.

Left alignment aperture wall 834 is formed in cover sidewall 808 and extends in a generally perpendicular direction toward left mounting wall 838. Right alignment aperture wall 836 is formed in cover sidewall 808 and extends in a generally perpendicular direction toward right mounting wall 840.

Figure 9A:
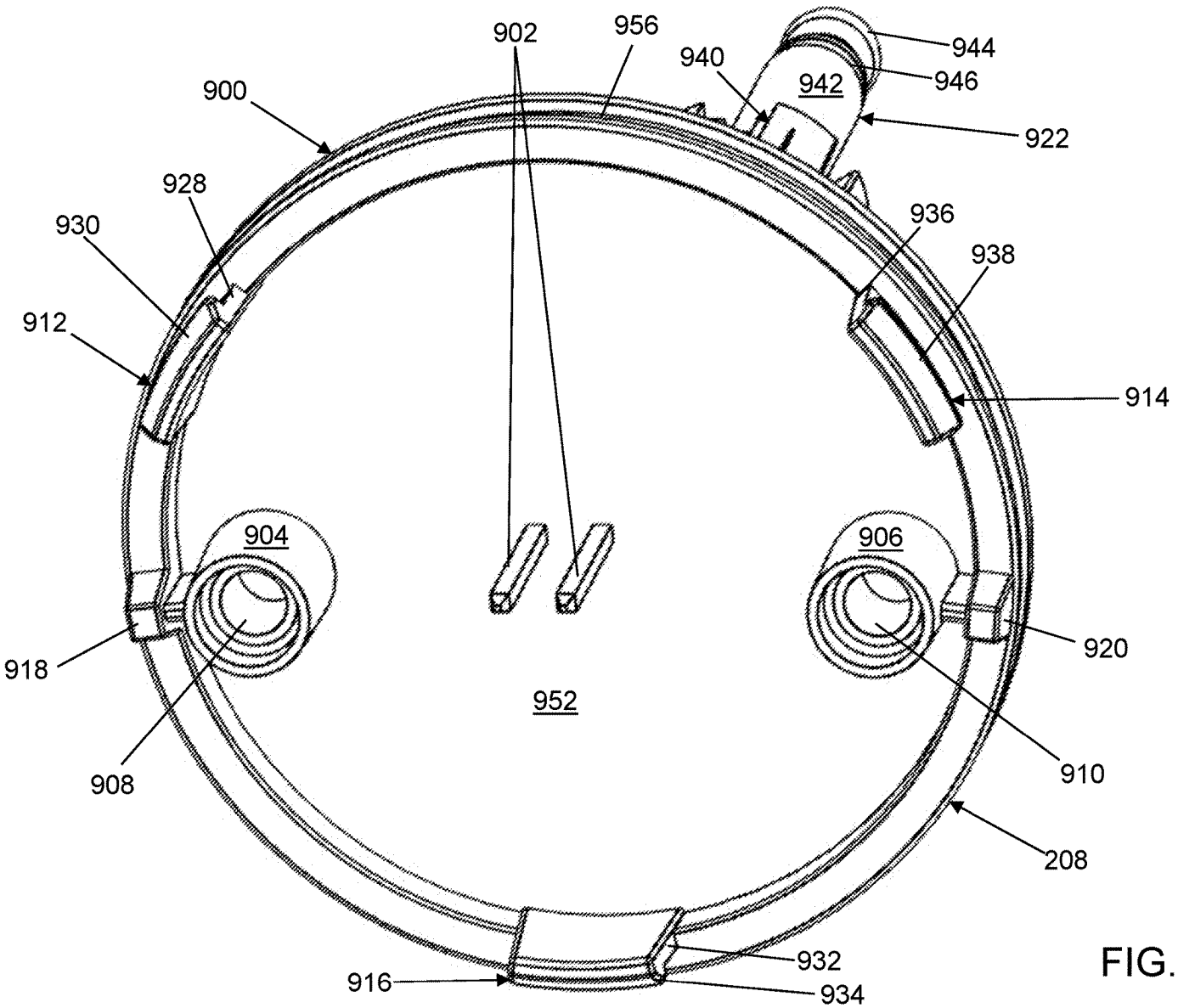
FIG. 9A depicts a front perspective view of a control rod assembly of the control knob of FIG. 2 in accordance with an illustrative embodiment.
Figure 9B:
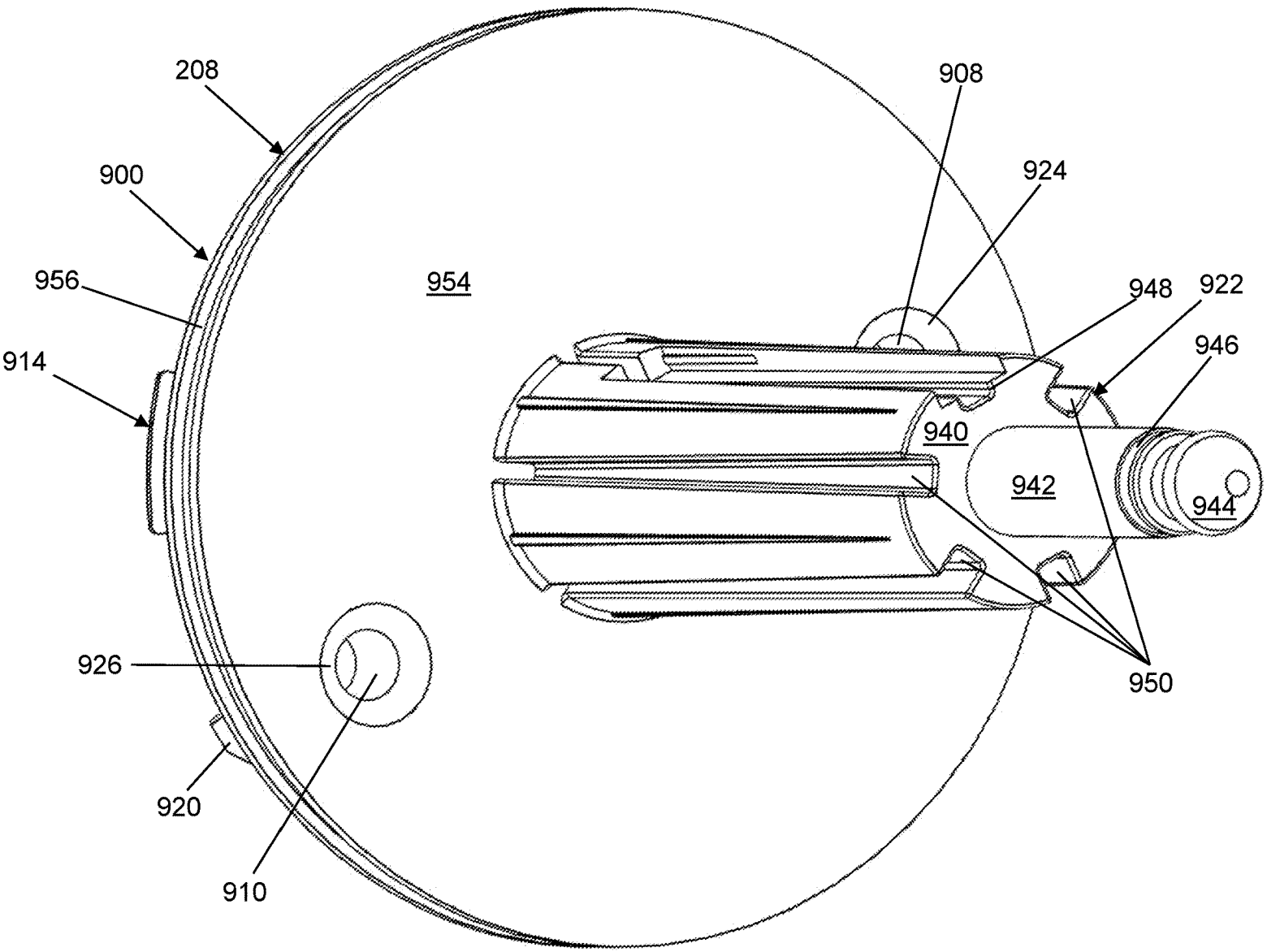
FIG. 9B depicts a back, right perspective view of the control rod assembly of FIG. 9A in accordance with an illustrative embodiment.

Referring to FIG. 9A, a front perspective view of control rod assembly 208 is shown in accordance with an illustrative embodiment. Referring to FIG. 9B, a back, right perspective view of control rod assembly 208 is shown in accordance with an illustrative embodiment. Control rod assembly 208 may include base plate 900, power connectors 902, a first base aperture wall 904, a second base aperture wall 906, a first base fastener shaft aperture wall 908, a second base fastener shaft aperture wall 910, first tab 912, second tab 914, third tab 916, a first alignment wall 918, a second alignment wall 920, a control rod 922, a first fastener head aperture wall 924, a second fastener head aperture wall 926, o-ring 400, first fastener o-ring 402, and second fastener o-ring 404.

Base plate 900 may include a front plate 952, a back plate 954, and an o-ring channel 956. Display 204 may be soldered to a display electronic circuit (not shown) that may be near a top of front plate 952. Front plate 952 may include an electronic circuit board on which the display electronic circuit is mounted. O-ring 400 is mounted in o-ring channel 956 to protect the display electronic circuit from external elements that may cause the display electronic circuit to malfunction. Other sealing methods may be used in alternative embodiments. For example, glue, sealing tape, tight fitting joints, foam, rubber, threads, or other materials or methods may be used. Power connectors 902 connect to the display electronic circuit and extend in a generally perpendicular direction away from front plate 952.

First base aperture wall 904 extends in a generally perpendicular direction away from front plate 952. First base fastener shaft aperture wall 908 is formed through base plate 900 within first base aperture wall 904. First base fastener shaft aperture wall 908 may be sized, shaped and positioned to allow insertion of the shaft of first fastener 302. First base fastener shaft aperture wall 908 does not extend to an edge of first base aperture wall 904 opposite front plate 952 to provide a wider diameter that allows insertion of first fastener o-ring 402 therein to further protect the display electronic circuit from external elements.

Second base aperture wall 906 extends in a generally perpendicular direction away from front plate 952. Second base fastener shaft aperture wall 910 is formed through base plate 900 within second base aperture wall 906. Second base fastener shaft aperture wall 910 may be sized, shaped and positioned to allow insertion of the shaft of second fastener 304. Second base fastener shaft aperture wall 910 does not extend to an edge of second base aperture wall 904 opposite front plate 952 to provide a wider diameter that allows insertion of second fastener o-ring 404 therein to further protect the display electronic circuit from external elements.

First fastener head aperture wall 924 is formed in back plate 954 and defines an aperture sized and shaped to accept a head of first fastener 302. Second fastener head aperture wall 926 is formed in back plate 954 and defines an aperture sized and shaped to accept a head of second fastener 304. First fastener head aperture wall 924 and second fastener head aperture wall 926 may provide a flat surface across back plate 954 by allowing the head of each fastener to be positioned below or flush with an exterior surface of back plate 954.

First tab 912 may include a first tab body 928 and a first tab head 930. First tab body 928 extends outward from front plate 952. First tab head 930 extends in a generally perpendicular direction outward from first tab body 928 opposite front plate 952. First tab body 928 is inserted through the first tab head aperture formed by first tab wall 818 and first tab aperture wall 820. First tab head 930 abuts first tab wall 818 to mount control rod assembly 208 to cover 300.

Second tab 914 may include a second tab body 936 and a second tab head 938. Second tab body 936 extends outward from front plate 952. Second tab head 938 extends in a generally perpendicular direction outward from second tab body 936 opposite front plate 952. Second tab body 936 is inserted through the second tab head aperture formed by second tab wall 822 and second tab aperture wall 824. Second tab head 938 abuts second tab wall 822 to mount control rod assembly 208 to cover 300.

Third tab 916 may include a third tab body 932 and a third tab head 934. Third tab body 932 extends outward from front plate 952. Third tab head 934 extends in a generally perpendicular direction outward from third tab body 932 opposite front plate 952. Third tab body 932 is inserted through the third tab head aperture formed by third tab wall 826 and third tab aperture wall 828. Third tab head 934 abuts third tab wall 826 to mount control rod assembly 208 to cover 300.

First alignment wall 918 extends in a generally perpendicular direction outward from a circumferential edge of front plate 952. First alignment wall 918 is sized, shaped, and positioned to fit within left alignment aperture wall 834 to ensure a proper alignment of cover 300 with control rod assembly 208.

Second alignment wall 920 extends in a generally perpendicular direction outward from a circumferential edge of front plate 952. Second alignment wall 920 is sized, shaped, and positioned to fit within right alignment aperture wall 836 to ensure a proper alignment of cover 300 with control rod assembly 208.

Base plate 900, first base aperture wall 904, second base aperture wall 906, first base fastener shaft aperture wall 908, second base fastener shaft aperture wall 910, first tab 912, second tab 914, third tab 916, first alignment wall 918, second alignment wall 920, first fastener head aperture wall 924, and second fastener head aperture wall 926 may be formed of an electrically insulating material, for example, using a molding process. Apertures may be formed through front plate 952 to allow insertion of power connectors 902 therethrough to provide corresponding connections to the electronic circuit. An aperture may be formed through back plate 954 to allow insertion of control rod therethrough to provide corresponding connections to the electronic circuit.

Control rod 922 may include a shaft sleeve body 940, a sleeve conductor 942, a tip 944, an insulator ring 946, a key slot 948, and slots 950. Shaft sleeve body 940 and insulator ring 946 may be formed of an electrically insulating material; whereas, sleeve conductor 942 and tip 944 may be formed of an electrically conductive material. For example, control rod 922 may be implemented as a bipolar connector such as a standard mono ¼ inch jack plug known in the art. Sleeve conductor 942 and tip 944 may each connect electrically to the electronic circuit. Key slot 948 and slots 950 are formed in shaft sleeve body 940 where key slot 948 ensures that shaft sleeve body 940 is aligned properly with the socket. Rotation of shaft sleeve body 940 with knob 202 may be converted into a signal, for example, an analog resistance or capacitance value or a digital coded value, which may be transmitted to the control system of the device by electronics (not shown) housed within electronics package 108. Presence of shaft sleeve body 940 in the socket may be monitored by the control system so that the device may be automatically shut down if control knob 102 is removed. For example, control rod 922 may provide both power and status information through tip 944 with sleeve conductor 942 used as a return or ground potential. The signal that carries the status information may be displayed by display 204.

In an illustrative embodiment, the signal alternates between two states, a rest state and a data transmission state. During the rest state, a voltage, for example 5 volts direct current (DC), is maintained on tip 944. During the data transmission state, a data transmission cycle is initiated by lowering the signal at the input to ground and transmitting data, for example using RS-232 serial communications. In an illustrative embodiment, the voltage maintained during the rest state voltage supplies power to the electronic circuit. One or more capacitors (not shown) may be used to store a charge to maintain power to the display electronic circuit during the data cycle. Preferably, separate capacitors may be used to provide power to display 204 and a microprocessor of the display electronic circuit.

Although in an illustrative embodiment, a bipolar connector carries power and status information, other types of connectors may be used that have more than two conductors. For example, a tripolar (three conductor) connector such as a stereo phone plug could be used, with one conductor for power, a second conductor for status information, and a third conductor for ground. A tripolar connector could also be used to support multiple displays within a single control knob by using, for example, one conductor for power and status to one display, a second conductor for power and status to a second display, and a third conductor for ground. A tripolar connector could also be used to support bidirectional communication between the control knob and the control system, for example by using one conductor for power and status to one display, a second conductor for status or control information from control knob 102, and a third conductor for ground.

Figure 10A:
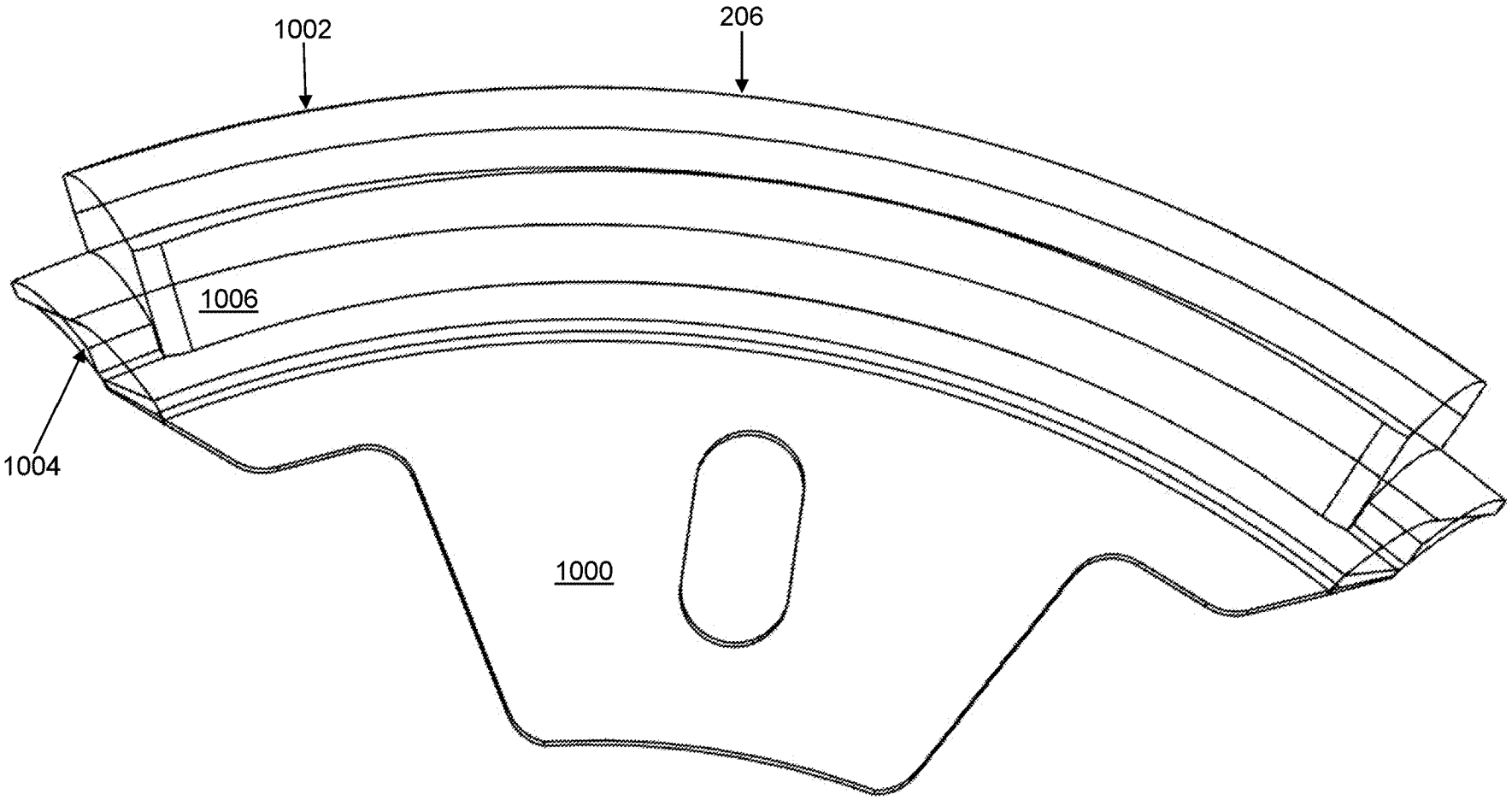
FIG. 10A depicts a front perspective view of the display cover of the control knob of FIG. 2 in accordance with an illustrative embodiment.
Figure 10B:
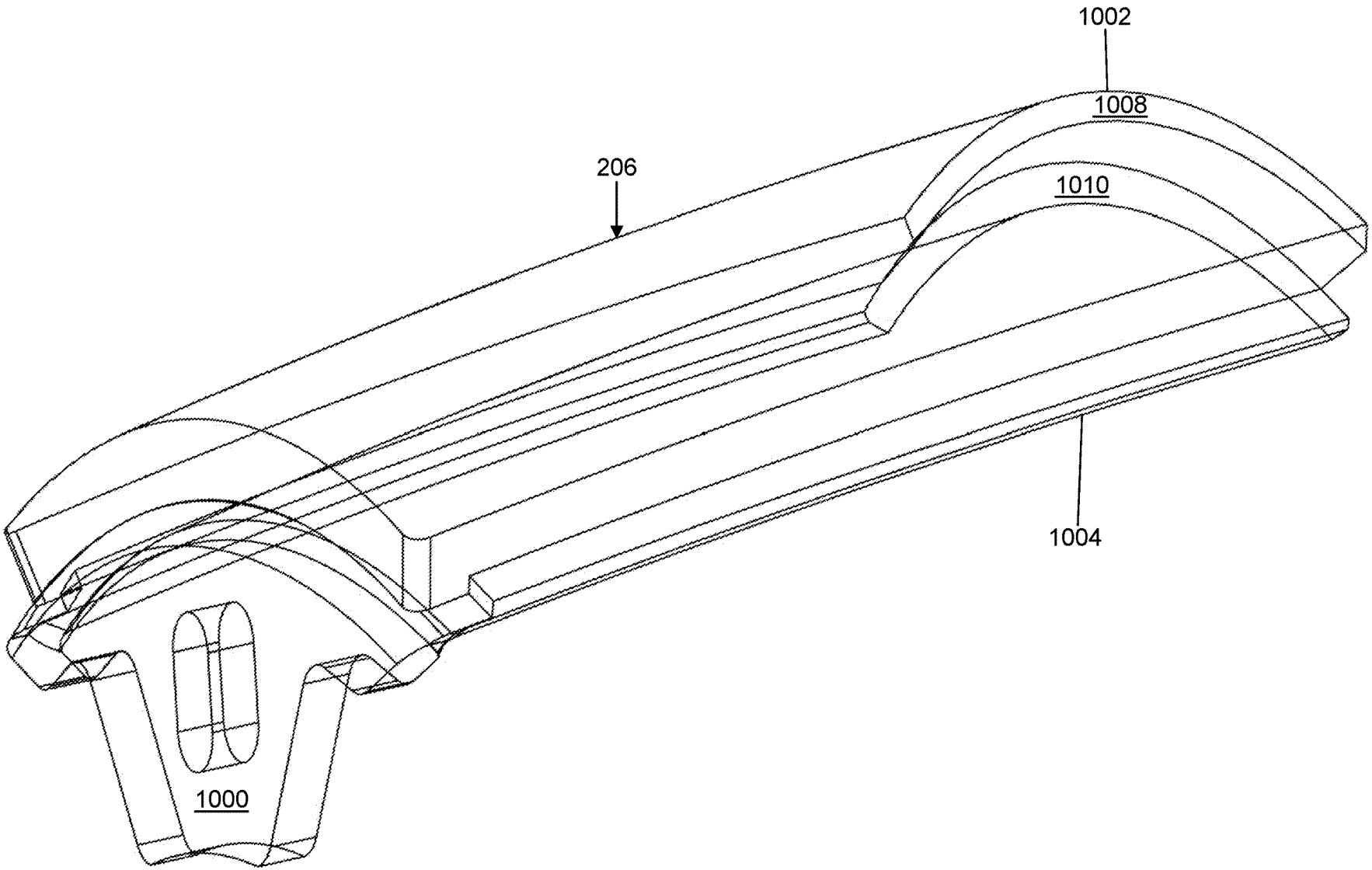
FIG. 10B depicts a right perspective view of the display cover of FIG. 10A in accordance with an illustrative embodiment.

Referring to FIG. 10A, a front perspective view of display cover 206 is shown in accordance with an illustrative embodiment. Referring to FIG. 10B, a right perspective view of display cover 206 is shown in accordance with an illustrative embodiment. Display cover 206 may include a mounting tab wall 1000, a top lens layer 1002, and a bottom lens layer 1004. Mounting tab wall 1000 extends in a generally perpendicular direction from bottom lens layer 1004 away from top lens layer 100. Mounting tab wall 1000 is shaped and positioned to abut an interior surface of knob rib 602.

Bottom lens layer 1004 further includes a bottom lens layer back edge 1010 that is on an opposite of mounting tab wall 1000. Top lens layer 1002 extends between a top lens layer front edge 1006 and a top lens layer back edge 1008. Top lens layer 1002 and bottom lens layer 1004 are arced and sized and shaped to fit within and be held in place by knob lens aperture wall 614. Bottom lens layer 1004 extends over a wider angle between left sidewall 632 and right sidewall 634 of knob lens aperture wall 614. Top lens layer front edge 1006 abuts left sidewall shelf 640 and right sidewall shelf 642. Top lens layer back edge 1008 abuts top lens curved shelf 638 and a sidewall surface of bottom lens curved wall 636 of knob lens aperture wall 614. Bottom lens layer back edge 1010 abuts a top surface of bottom lens curved wall 636 of knob lens aperture wall 614.

Display cover 206 is formed of a transparent material, such as glass or plastic, so that the user of the device can see display front face 1102 while also protecting display front face 1102 from external elements. Though the term lens is used herein, it is not to be construed as necessarily concentrating or dispersing light. A color of display cover 206 may be chosen to reduce a visibility of display front face 1102 when display 204 is off, for example, when control knob 102 is not in use or the device is off.

Figure 11B:
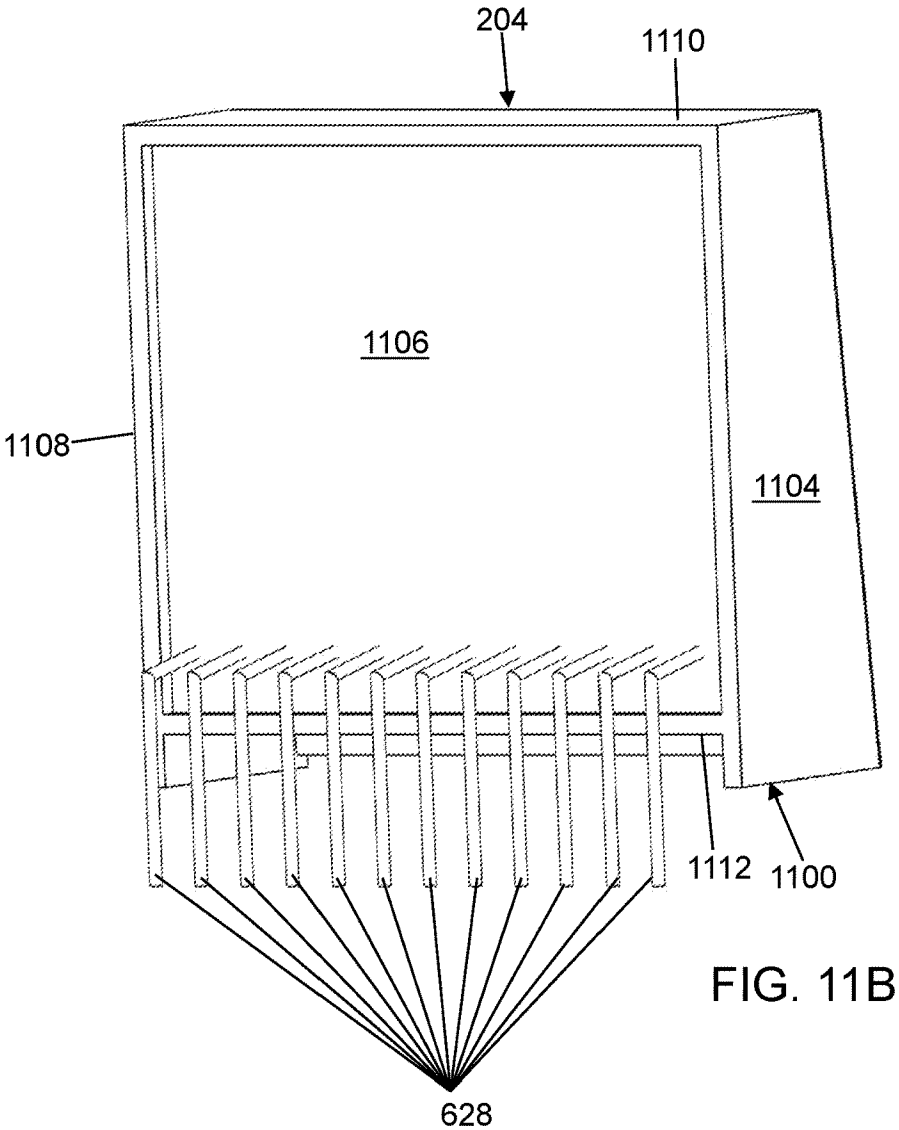
FIG. 11B depicts a bottom perspective view of the display of FIG. 11A in accordance with an illustrative embodiment.
Figure 11A:
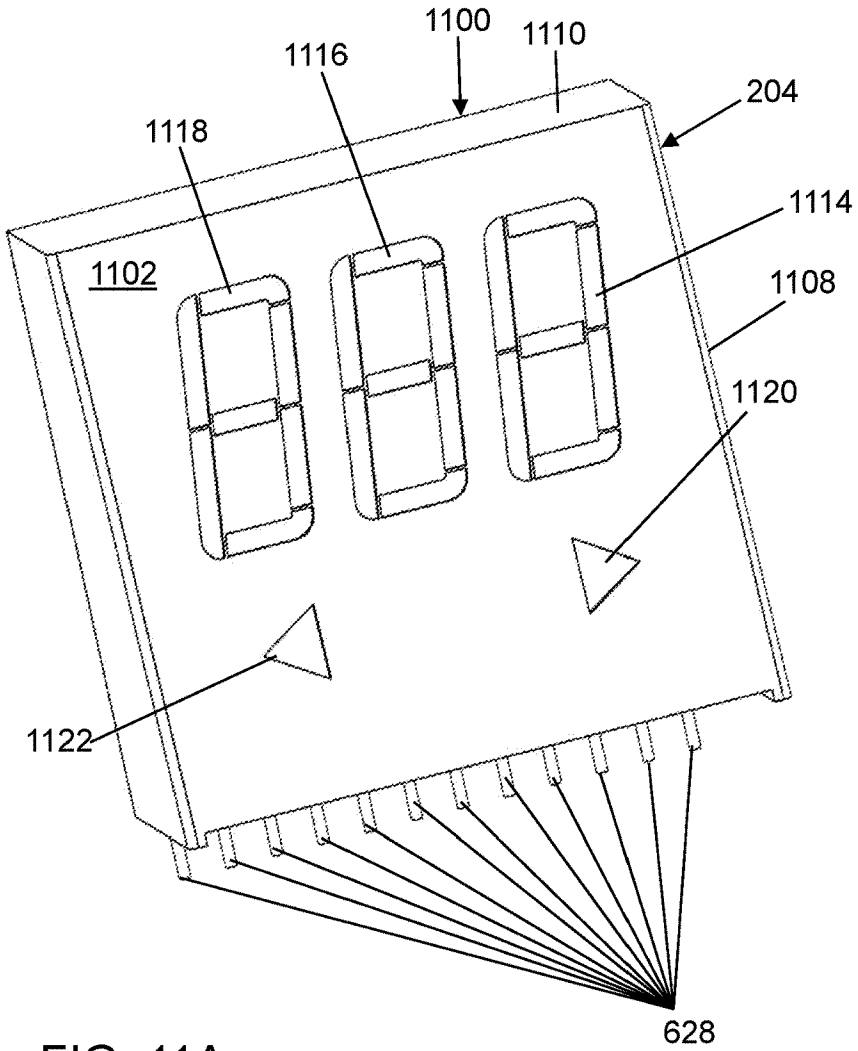
FIG. 11A depicts a top perspective view of the display of the control knob of FIG. 2 in accordance with an illustrative embodiment.

Referring to FIG. 11A, a top perspective view of display 204 is shown in accordance with an illustrative embodiment. Referring to FIG. 11B, a bottom perspective view of display 204 is shown in accordance with an illustrative embodiment. Display 204 may include display control pins 628, display housing 1100. Display housing 1100 may include display front face 1102, a right sidewall 1104, back wall 1106, a left sidewall 1108, a top wall 1110, and a bottom wall 1112. Right sidewall 1104 and left sidewall 1108 are shaped to slide along the sides of display guide legs 618 and to provide a friction fit against display guide legs 618 to hold display housing 1100 in position. Display housing 1100 may be formed of various materials including plastic. Display control pins 628 may be soldered to the electronic circuit.

One or more display item may be formed on display front face 1102. For example, display front face 1102 may include a plurality of light emitting diodes (LEDs) arranged to form a first digit 1114, a second digit 1116, a third digit 1118, an increase indicator 1122, and a decrease indicator 1120. In the illustrative embodiment, first digit 1114, second digit 1116, and third digit 1118 are used to indicate a set temp of an oven, an actual temp of the oven, a three character message for a mode without a temperature (e.g., sabbath, clean, broil), an error status, and a version number. Increase indicator 1122 indicates when the set temperature can be increased. If the oven is at the maximum set temperature allowed in that mode, the increase indicator is off. Decrease indicator 1120 indicates when the set temperature can be decreased. If the oven is at the minimum set temperature allowed in that mode, the decrease indicator is off. The decision to light first digit 1114, second digit 1116, third digit 1118, increase indicator 1122, and decrease indicator 1120 is made in the control system (not shown). The display electronic circuit in knob 202 illuminates segments of display 204 based on communication data from the control system.

Figure 12A:
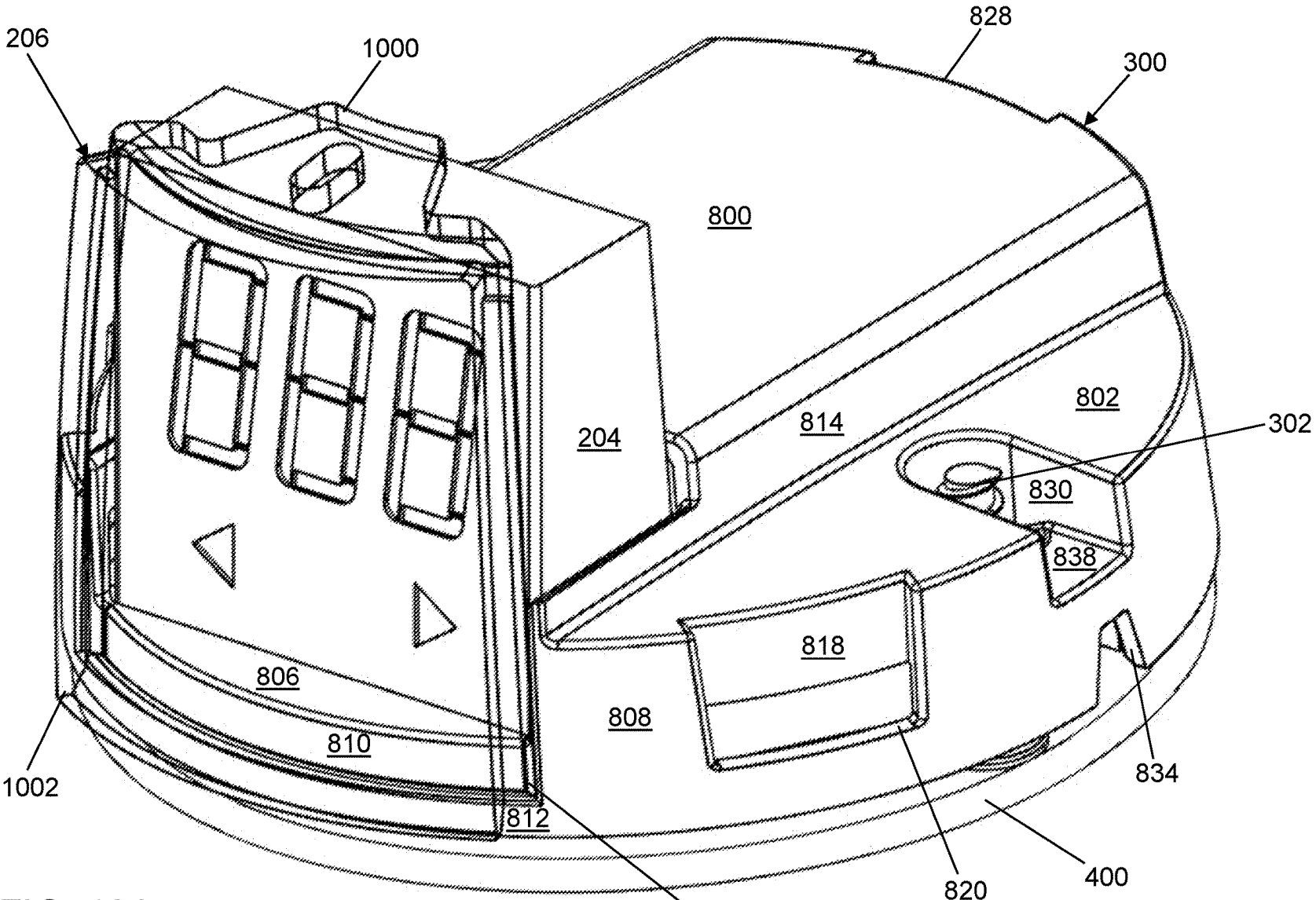
FIG. 12A depicts a top, front perspective view of the control knob of FIG. 2 without the knob and without the control rod assembly in accordance with an illustrative embodiment.
Figure 12B:
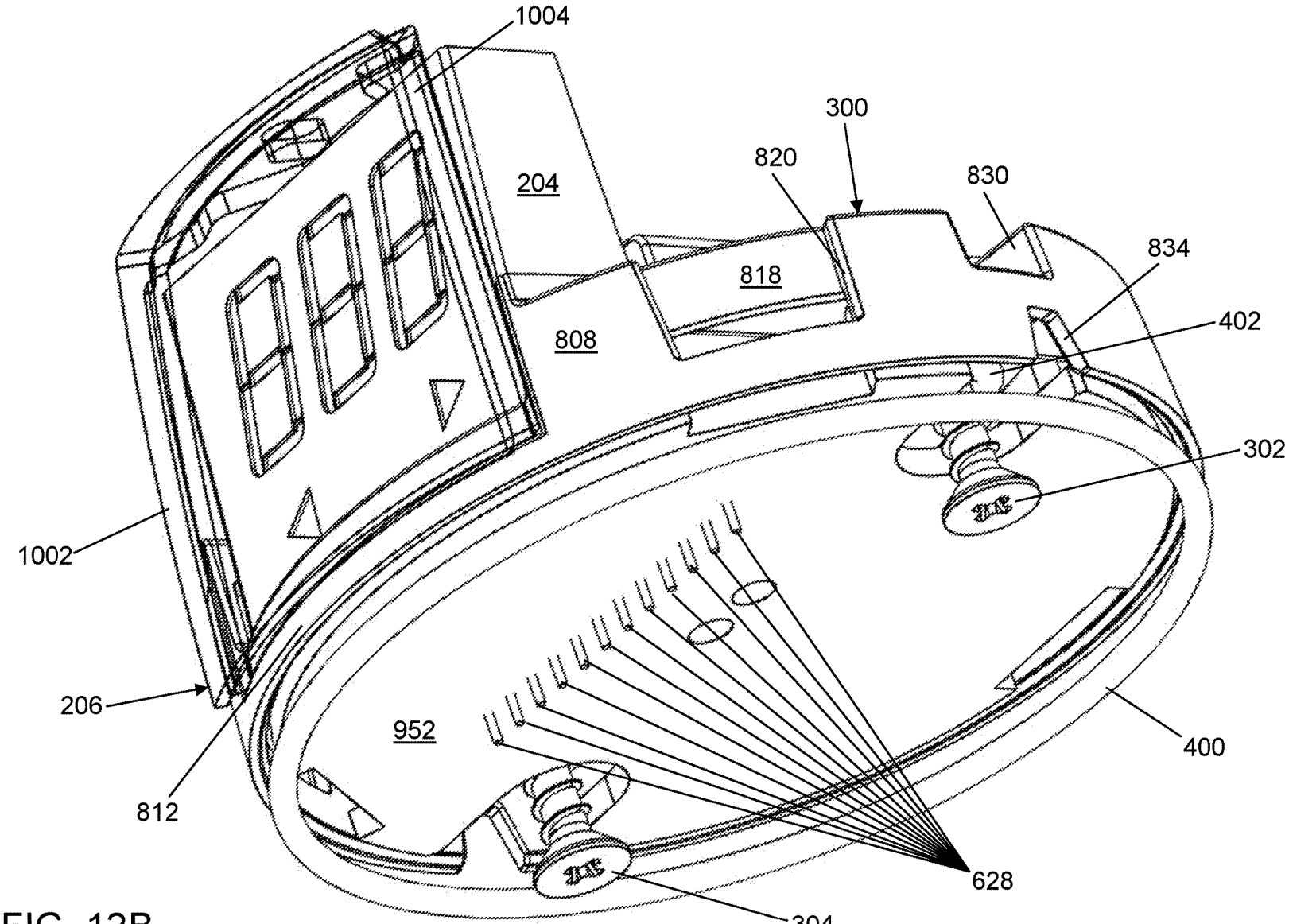
FIG. 12B depicts a top, back perspective view of the control knob of FIG. 12A in accordance with an illustrative embodiment.
Figure 12C:
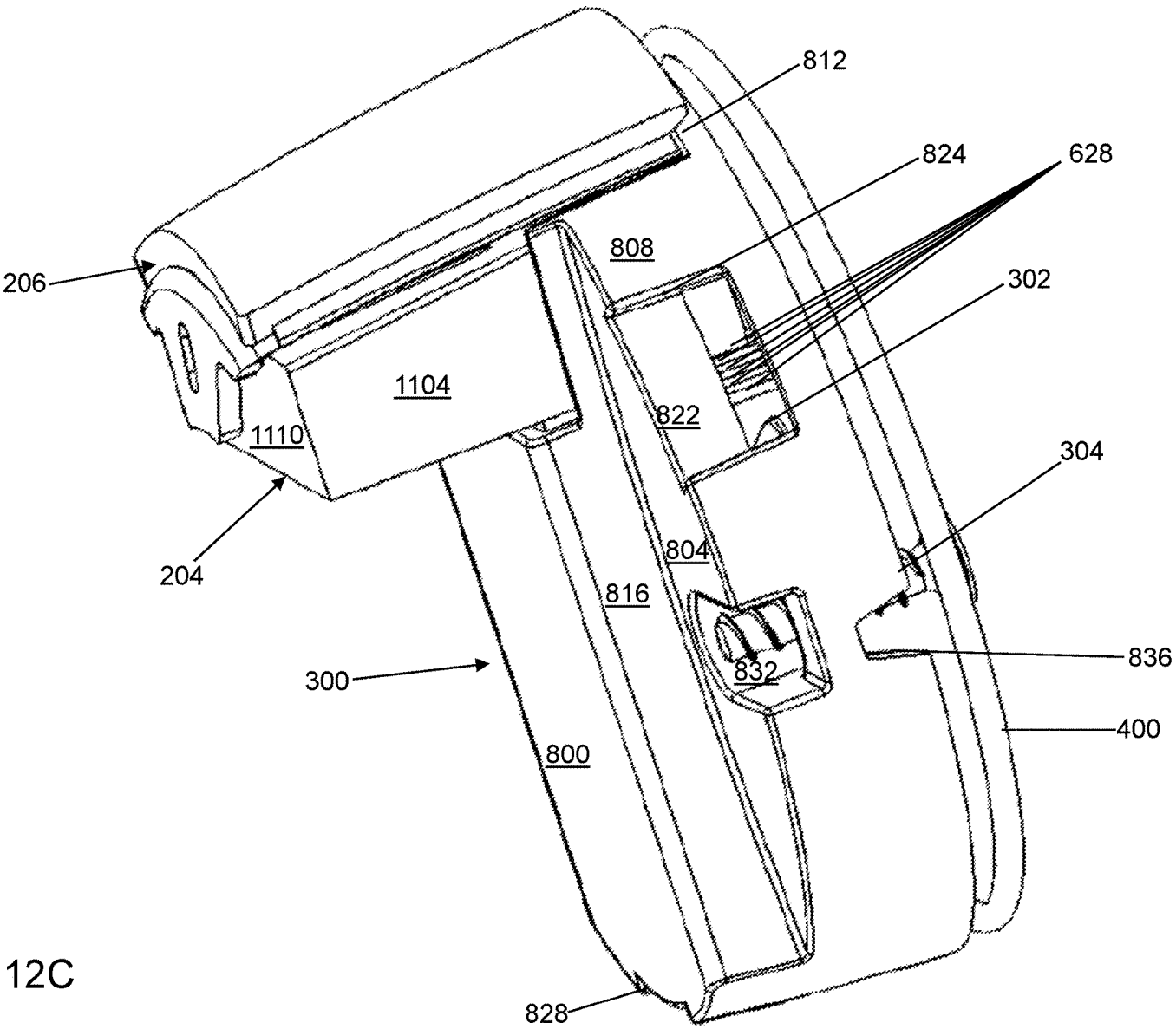
FIG. 12C depicts a right perspective view of the control knob of FIG. 12A in accordance with an illustrative embodiment.
Figure 12D:
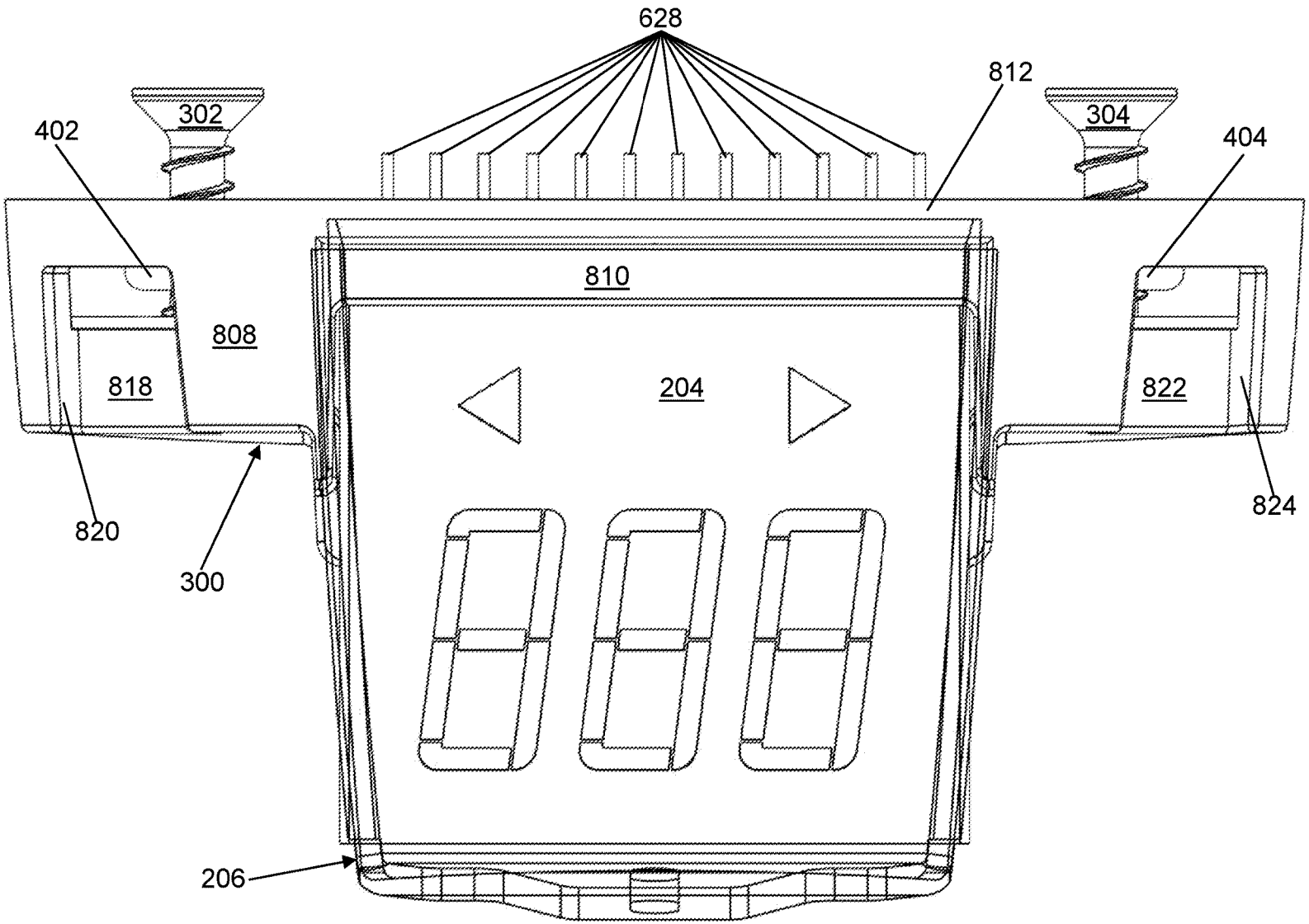
FIG. 12D depicts a top view of the control knob of FIG. 12A in accordance with an illustrative embodiment.
Figure 12E:
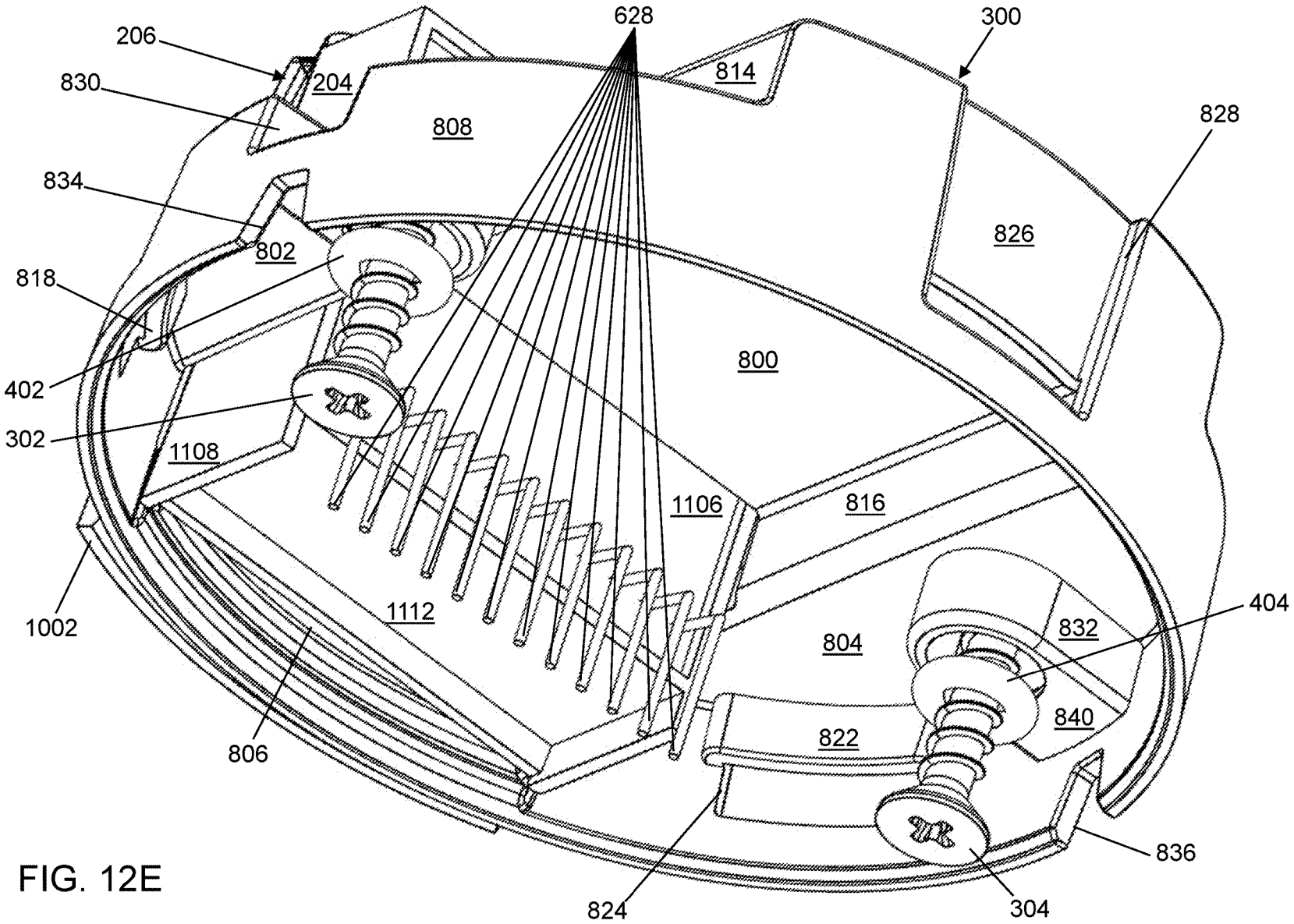
FIG. 12E depicts a back, bottom perspective view of the control knob of FIG. 12A in accordance with an illustrative embodiment.

Referring to FIG. 12A, a top, front perspective view of control knob 102 without knob 202 and control rod assembly 208 is shown in accordance with an illustrative embodiment. Referring to FIG. 12B, a top, back perspective view of control knob 102 without knob 202 and control rod assembly 208 is shown in accordance with an illustrative embodiment. Referring to FIG. 12C, a right perspective view of control knob 102 without knob 202 and control rod assembly 208 is shown in accordance with an illustrative embodiment. Referring to FIG. 12D, a top view of control knob 102 without knob 202 and control rod assembly 208 is shown in accordance with an illustrative embodiment. Referring to FIG. 12E, a back, bottom perspective view of control knob 102 without knob 202 and control rod assembly 208 is shown in accordance with an illustrative embodiment.

For illustration, display 204 can be used to present a temperature of an oven 120 and control knob 102 may be used to set, increase, or decrease the temperature of oven 120. Display 204 may produce more than one color, for example red and black, to match the color of the knob housing or for other aesthetic reasons. The display 204 may also produce more than one color, for example red and green, to indicate different status information, such as error conditions, a preheat cycle, or for other functional reasons.

The display 204 may provide multiple types of information, for example oven temperature setpoint, actual oven temperature, probe setpoint, probe temperature, and error codes. The multiple types of information could be provided at the same time using non-numeric indicators, for example different colors or blinking, or by alternating between two different types of information, for example, by alternating between oven temperature setpoint and actual oven temperature.

Figure 13:
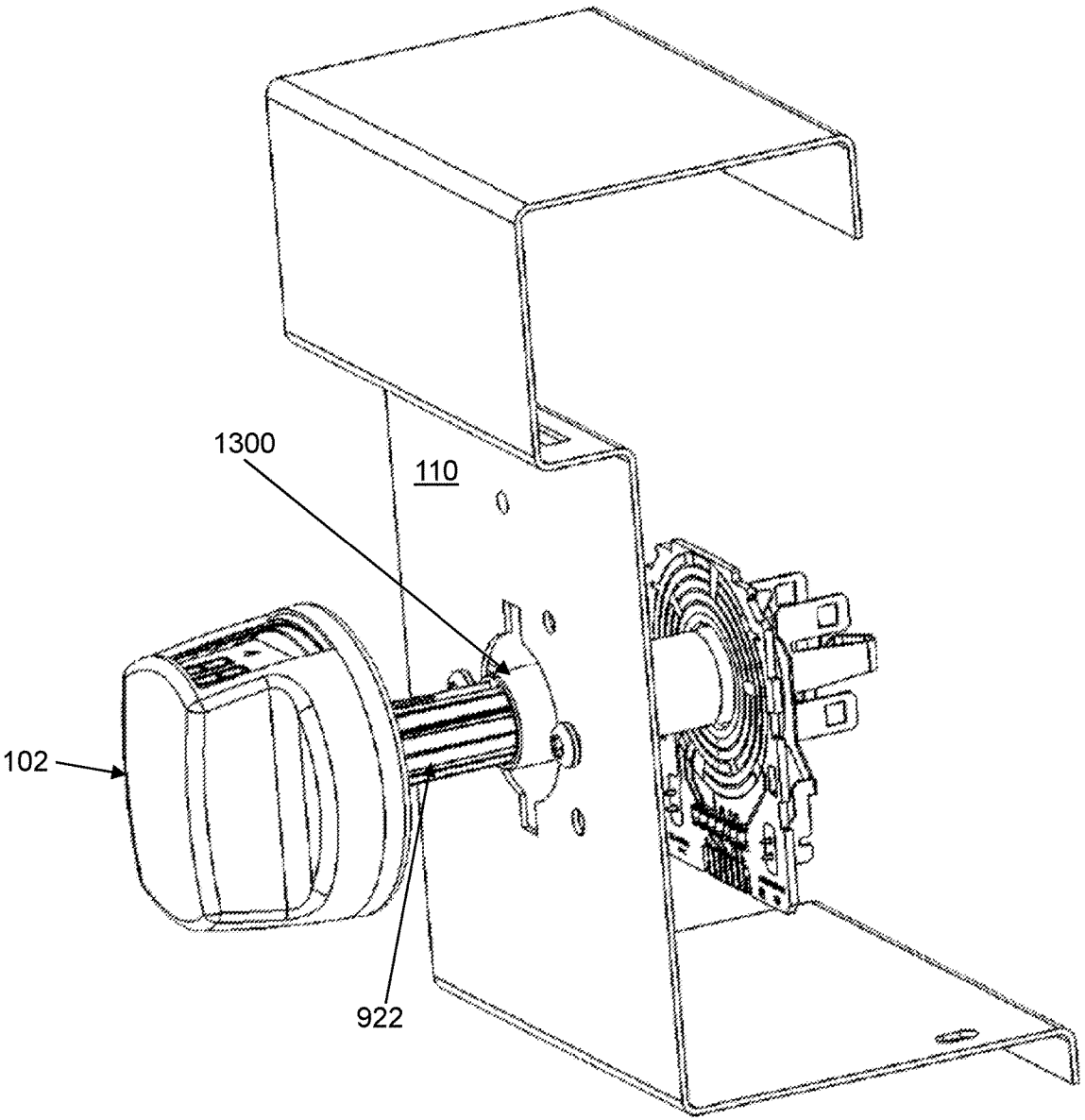
FIG. 13 depicts a front perspective view of the control knob of FIG. 2 mounted to a control rod socket in accordance with an illustrative embodiment.

Referring to FIG. 13, a front perspective view of mounting plate 110 to which control knob 102 may be mounted is shown in accordance with an illustrative embodiment. Back plate 954 of base plate 900 may mount flush with or adjacent a first side of mounting plate 110 on which knob 302 is located. A knob mounting aperture 1300 is formed through mounting plate 110 and is sized to accept at least a portion of shaft sleeve body 940 therethrough.

The display electronic circuit may be implemented as a digital electronic circuit that may include a microprocessor and a connector socket to provide an electrical connection with power connectors 902 as well as other optional electronic circuit components. Display control pins 628 may connect to the microprocessor which controls the presentation of information in display front face 1102 and which receives an indication of a selection of one or more indicators such as increase indicator 1122 or decrease indicator 1120 to modify the presentation of the information as well as the operation of the device such as the oven. Other types of processors may be used in alternative embodiments, such as a microcontroller, programmable logic device, etc.

Figure 14A:
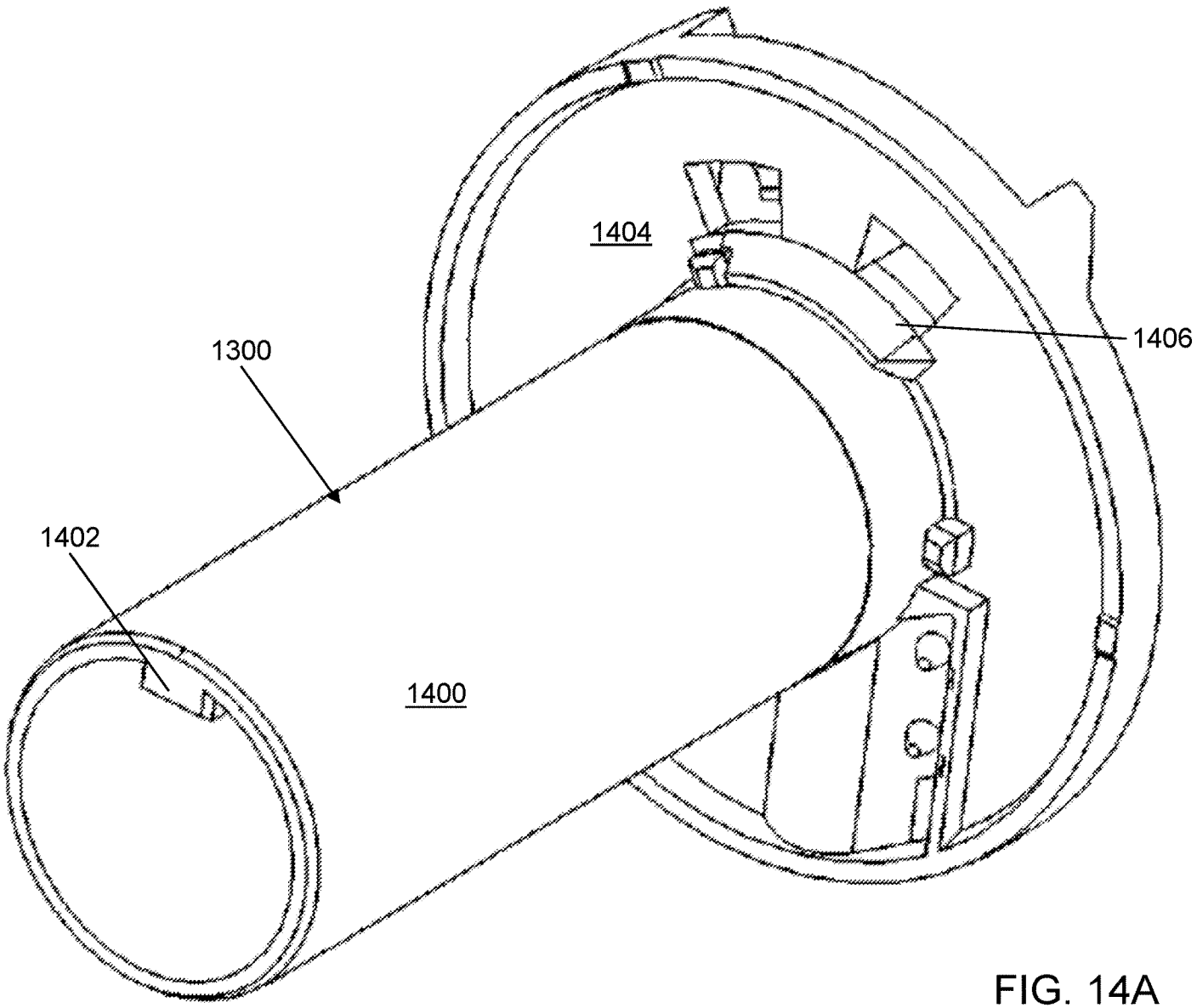
FIG. 14A depicts a front perspective view of the control rod socket of FIG. 13 in accordance with an illustrative embodiment.
Figure 14B:
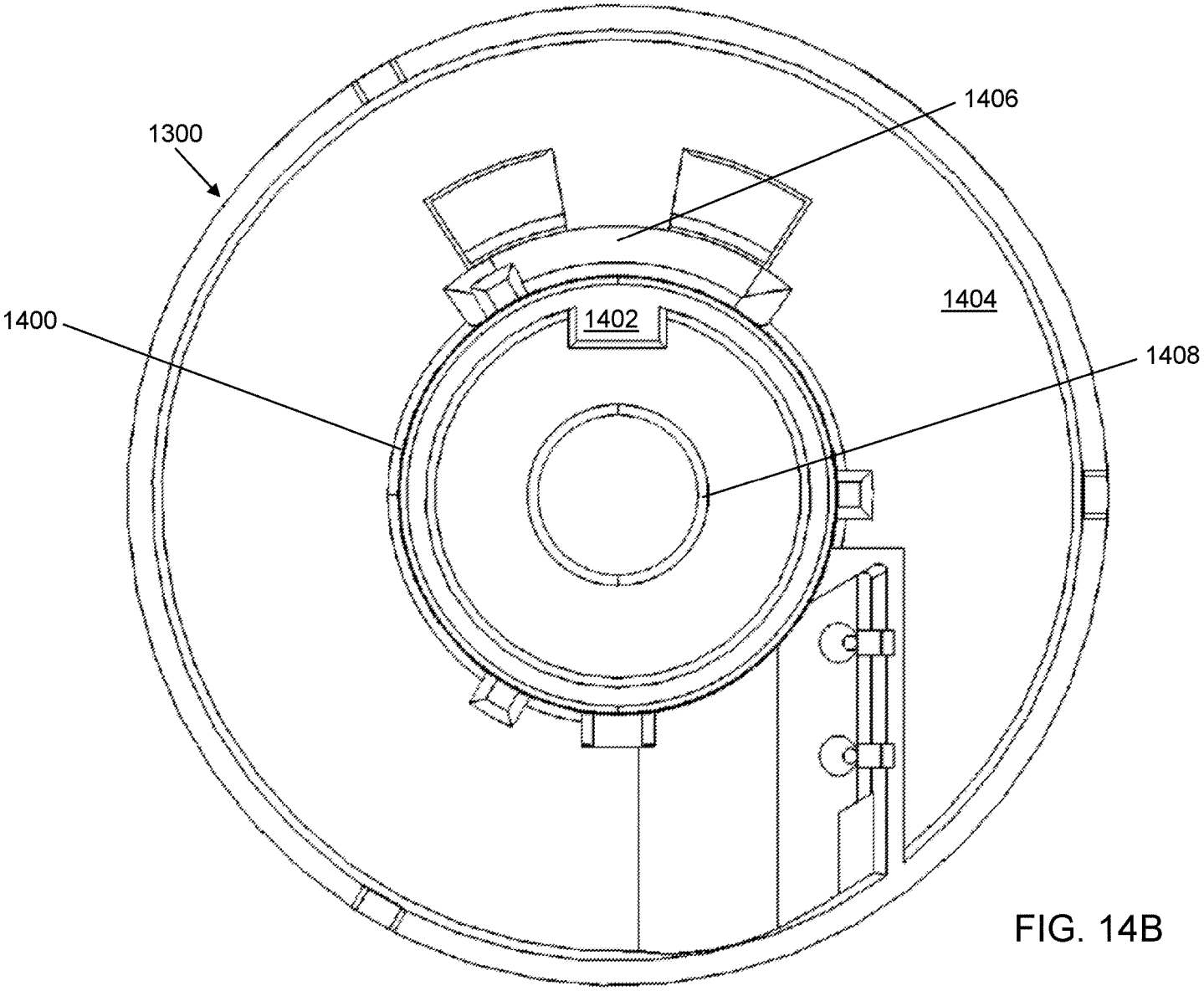
FIG. 14B depicts a front view of the control rod socket of FIG. 13 in accordance with an illustrative embodiment.
Figure 14C:
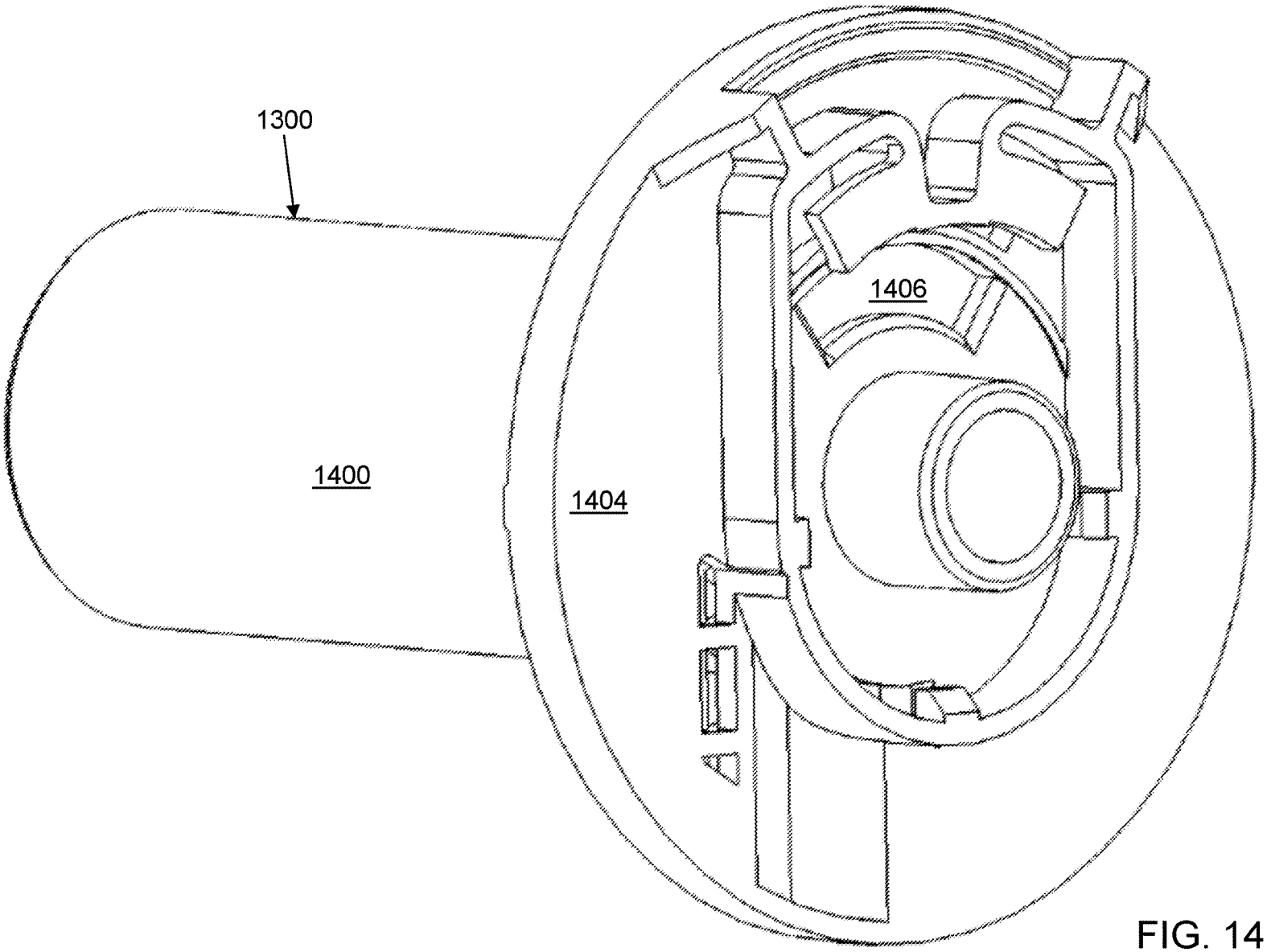
FIG. 14C depicts a back perspective view of the control rod socket of FIG. 13 in accordance with an illustrative embodiment.

Referring to FIG. 13, a front perspective view of control knob 102 mounted to a control rod socket 1300 is shown in accordance with an illustrative embodiment. Referring to FIG. 14A, a front perspective view of control rod socket 1300 is shown in accordance with an illustrative embodiment. Referring to FIG. 14B, a front view of control rod socket 1300 is shown in accordance with an illustrative embodiment. Referring to FIG. 14C, a back perspective view of control rod socket 1300 is shown in accordance with an illustrative embodiment. Control rod socket 1300 may include a cylinder 1400, a key tab 1402, a disc 1404, an angle limiter 1406, and a tip aperture 1408. Key tab 1402 is formed to extend inward from an interior surface of cylinder 1400 and is shaped, sized, and positioned to align with key slot 948 when control knob 102 is mounted to control rod socket 1300. Disc 1404 extends generally perpendicularly from an exterior surface of a base of cylinder 1400. Disc 1404 mounts to electronics package 108 that detects an angle of rotation of control knob 102. In the illustrative embodiment, angle limiter 1406 structurally limits a rotation angle of control knob 102 to ±30 degrees though other angle limits may be defined. Tip aperture 1408 is formed through a center of disc 1404 and is sized, shaped and positioned to accept tip 944 when control knob 102 is mounted to control rod socket 1300. Control knob 102 may be removed, for example, by pulling away from control rod socket 1300 to release tip 944. Key slot 948 may be mounted upwards when control knob 102 is inserted in control rod socket 1300. Cylinder 1400 defines an aperture through which control rod 922 can be inserted.

Figure 15:
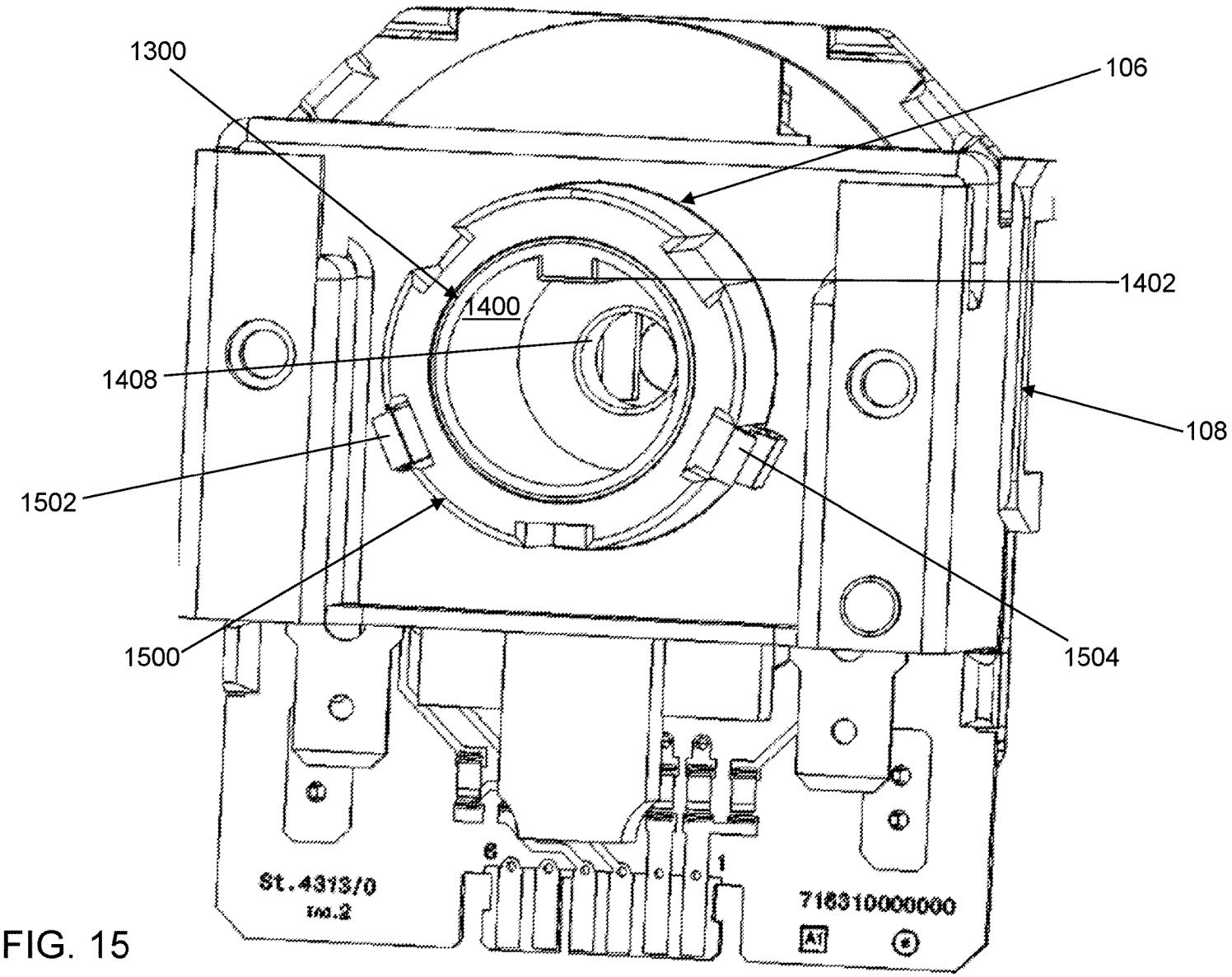
FIG. 15 depicts a front perspective view of a mounting mechanism mounted to an electronics package in accordance with an illustrative embodiment.

Referring to FIG. 15, a front perspective view of mounting mechanism 106 mounted to electronics package 108 is shown in accordance with an illustrative embodiment. Mounting mechanism 106 may include control rod socket 1300 that mounts control knob 102 to electronics package 108 and a bezel socket 1500 that mounts mode bezel 104 to electronics package 108. A first spring clip 1502 and a second spring clip 1504 may further mount mode bezel 104 to bezel socket 1500. A greater or a fewer number of springs may be included in alternative embodiments.

Figure 16:
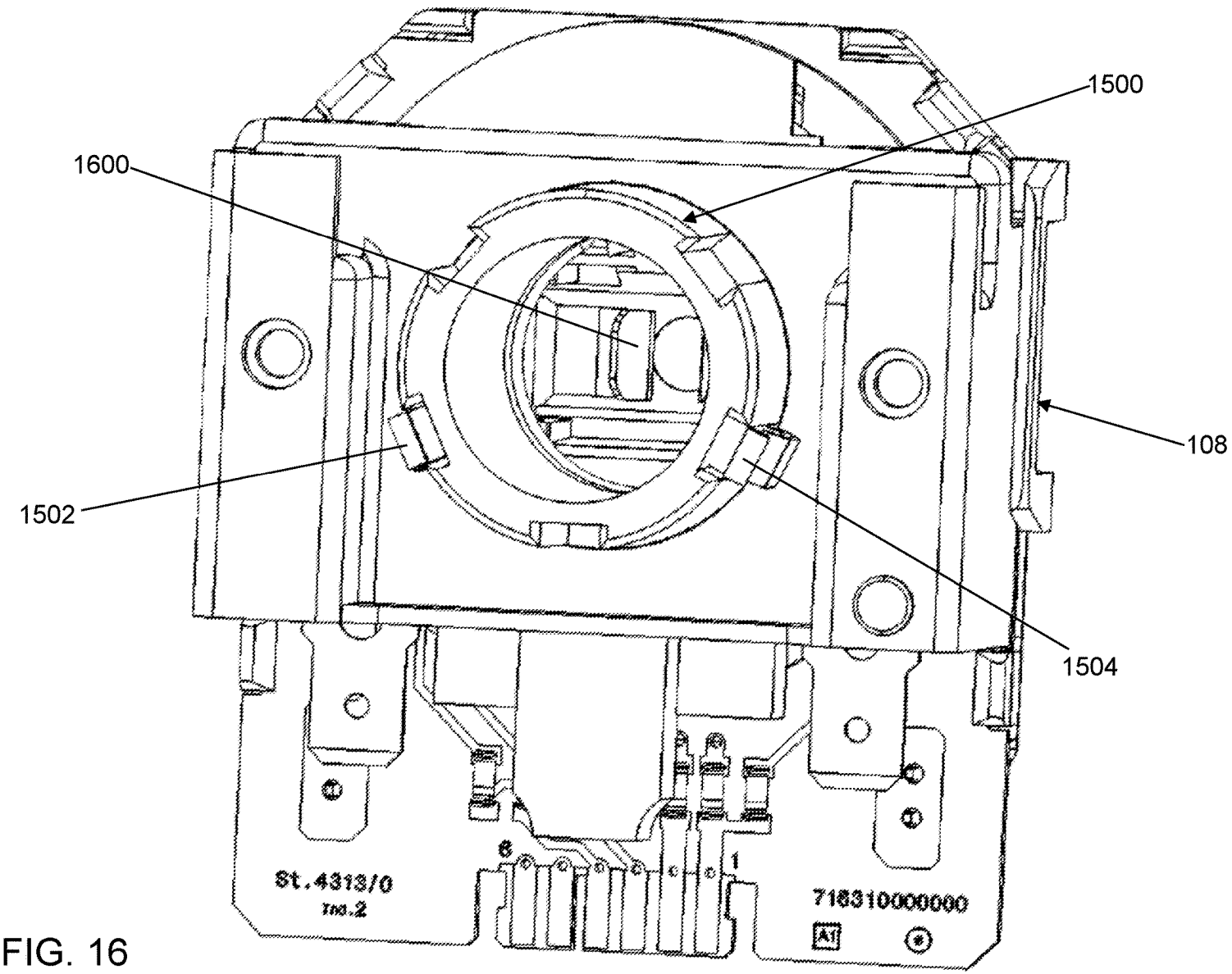
FIG. 16 depicts a front perspective view of a bezel socket mounted the electronics package in accordance with an illustrative embodiment.

Referring to FIG. 16, a front perspective view of bezel socket 1500 mounted to electronics package 108 is shown in accordance with an illustrative embodiment. An electronic contact 1600 of electronics package 108 is positioned to contact tip 944 when control knob 102 is mounted to control rod socket 1300, and control rod socket 1300 is mounted to electronics package 108. In the illustrative embodiment, control rod socket 1300 fits within an interior of bezel socket 1500. Bezel socket 1500 can be rotated independent of control rod socket 1300.

Figure 17:
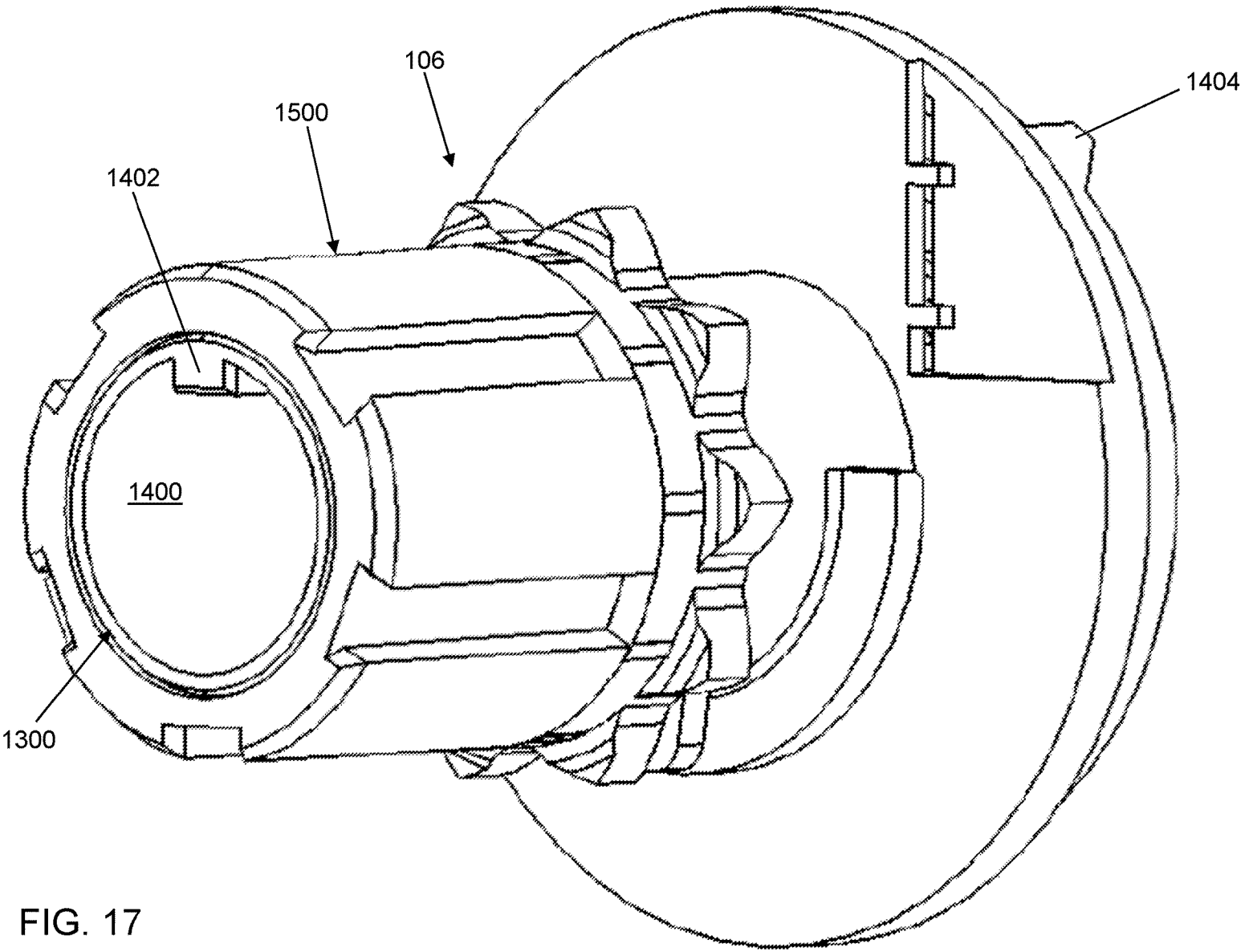
FIG. 17 depicts a front perspective view of the mounting mechanism of FIG. 15 in accordance with an illustrative embodiment.
Figure 18:
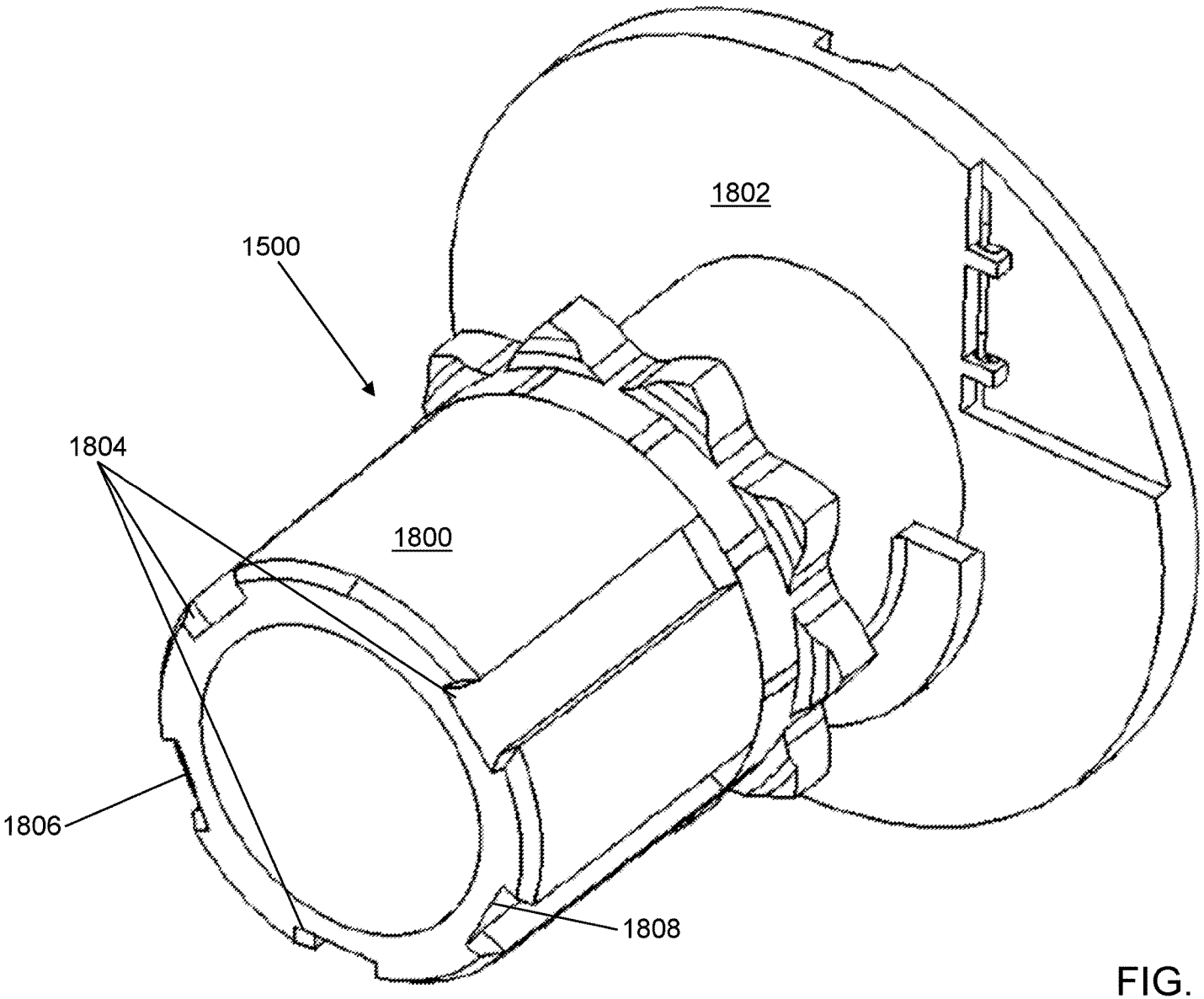
FIG. 18 depicts a front perspective view of the bezel socket of FIG. 16 in accordance with an illustrative embodiment.

Referring to FIG. 17, a front perspective view of mounting mechanism 106 is shown in accordance with an illustrative embodiment. Referring to FIG. 18, a front perspective view of bezel socket 1500 is shown in accordance with an illustrative embodiment. Bezel socket 1500 may include a bezel socket cylinder 1800, a bezel socket disc 1802, one or more alignment grooves 1804, a first spring groove 1806, and a second spring groove 1808. Bezel socket cylinder 1800 is sized and shaped to fit within a bezel cylinder 1904 (shown referring to FIG. 19A) of mode bezel 104. The one or more alignment grooves 1804 are formed to extend inward from an exterior surface of bezel socket cylinder 1800 and are shaped, sized, and positioned to align with and accept one or more bezel protrusions 1906 (shown referring to FIG. 19A) when mode bezel 104 is mounted to bezel socket 1500. First spring groove 1806 and second spring groove 1808 are formed to extend inward from the exterior surface of bezel socket cylinder 1800 and are shaped, sized, and positioned to align with a first tab slot 1908 (shown referring to FIG. 19A) and a second tab slot 1910 (shown referring to FIG. 19B) when mode bezel 104 is mounted to bezel socket 1500. First spring clip 1502 fits within first spring groove 1806, and second spring clip 1504 fits within second spring groove 1808 when mode bezel 104 is mounted to bezel socket 1500. Bezel socket disc 1802 extends generally perpendicularly from an exterior surface of a base of cylinder 1400. Bezel socket disc 1802 mounts to electronics package 108 that detects an angle of rotation of mode bezel 104 to determine a mode of operation of the device. Mode bezel 104 may be removed, for example, by pulling away from bezel socket 1500.

Figure 19A:
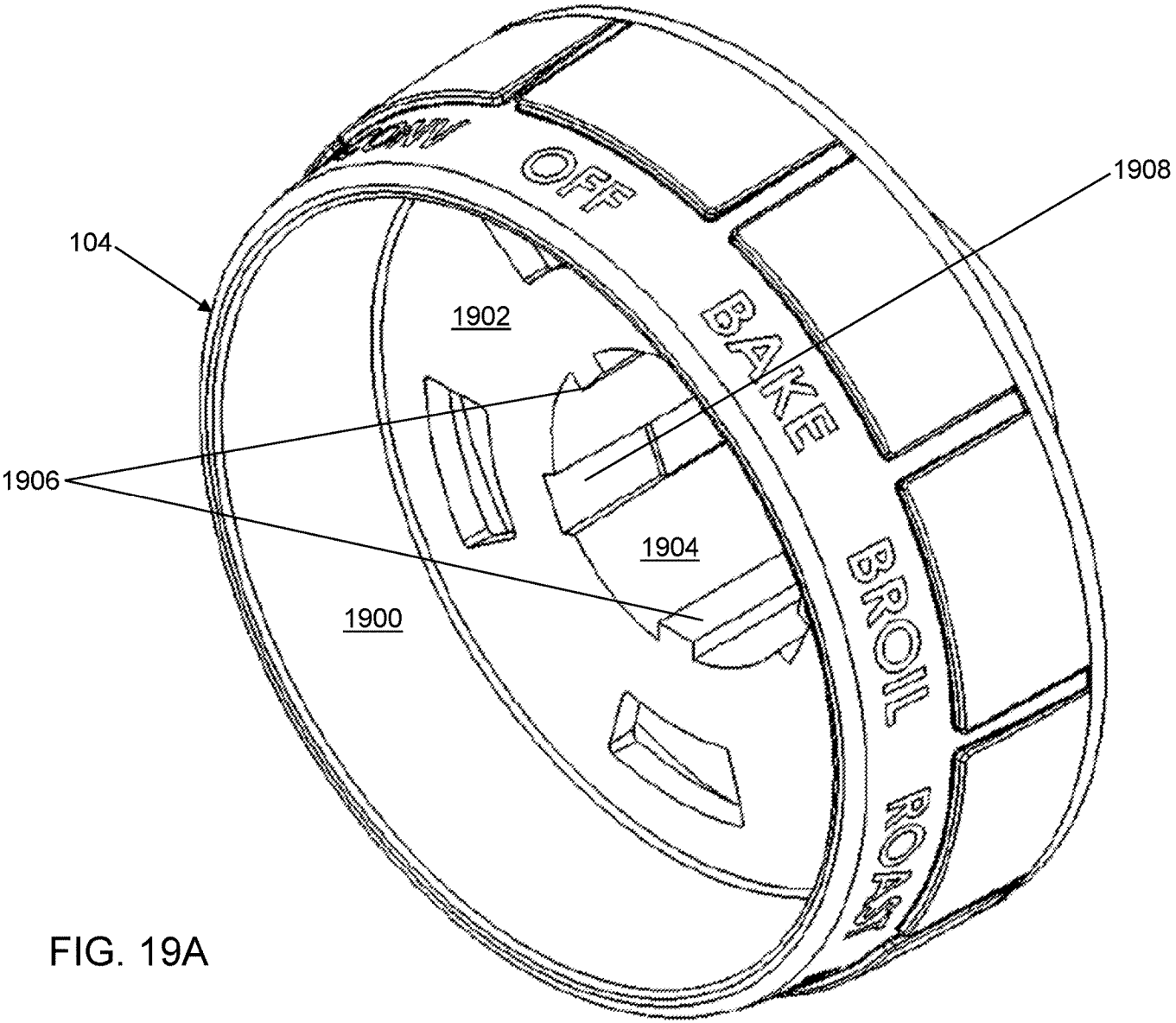
FIG. 19A depicts a front perspective view of a mode bezel in accordance with an illustrative embodiment.
Figure 19B:
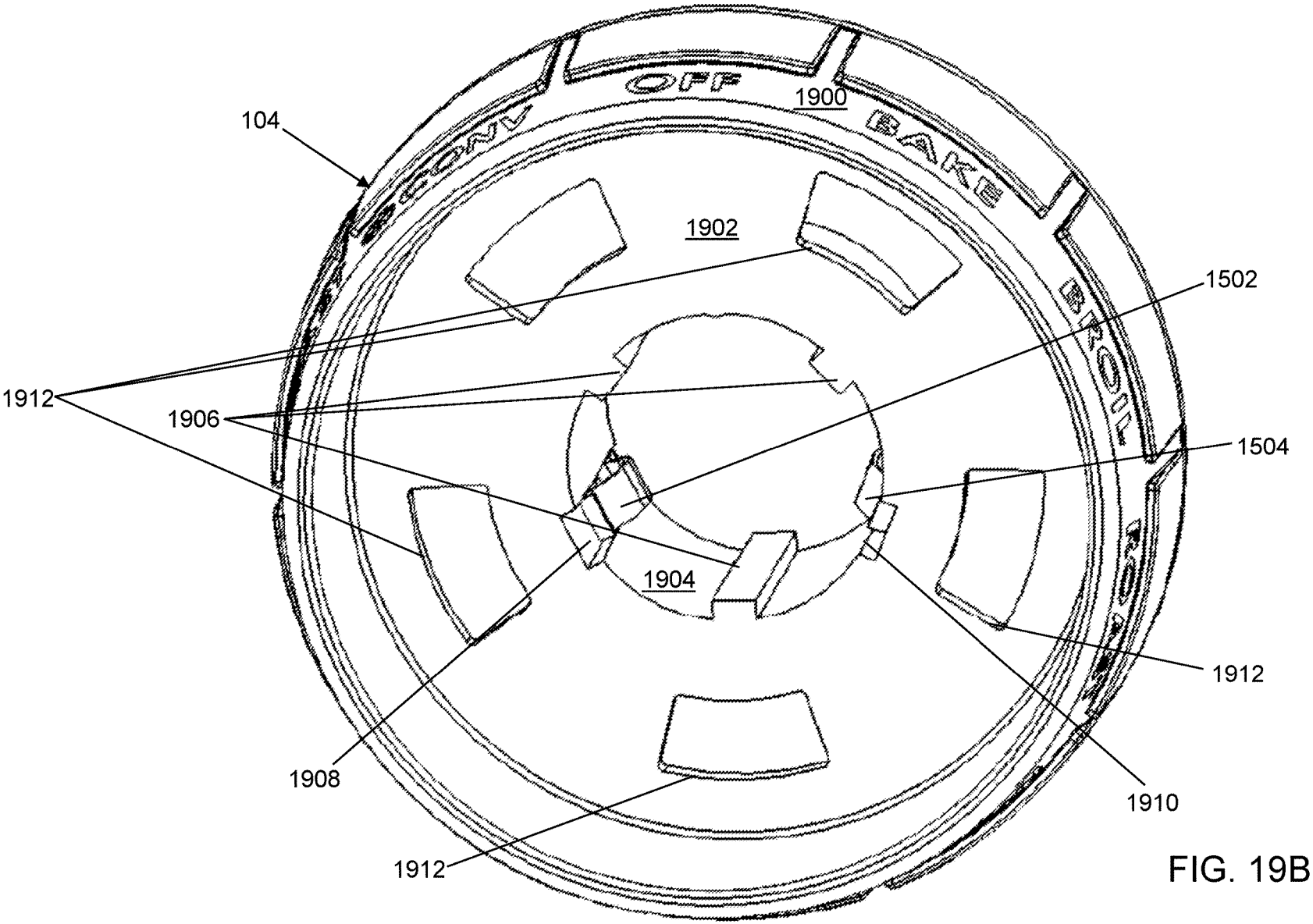
FIG. 19B depicts a front view of the mode bezel of FIG. 19A in accordance with an illustrative embodiment.
Figure 19C:
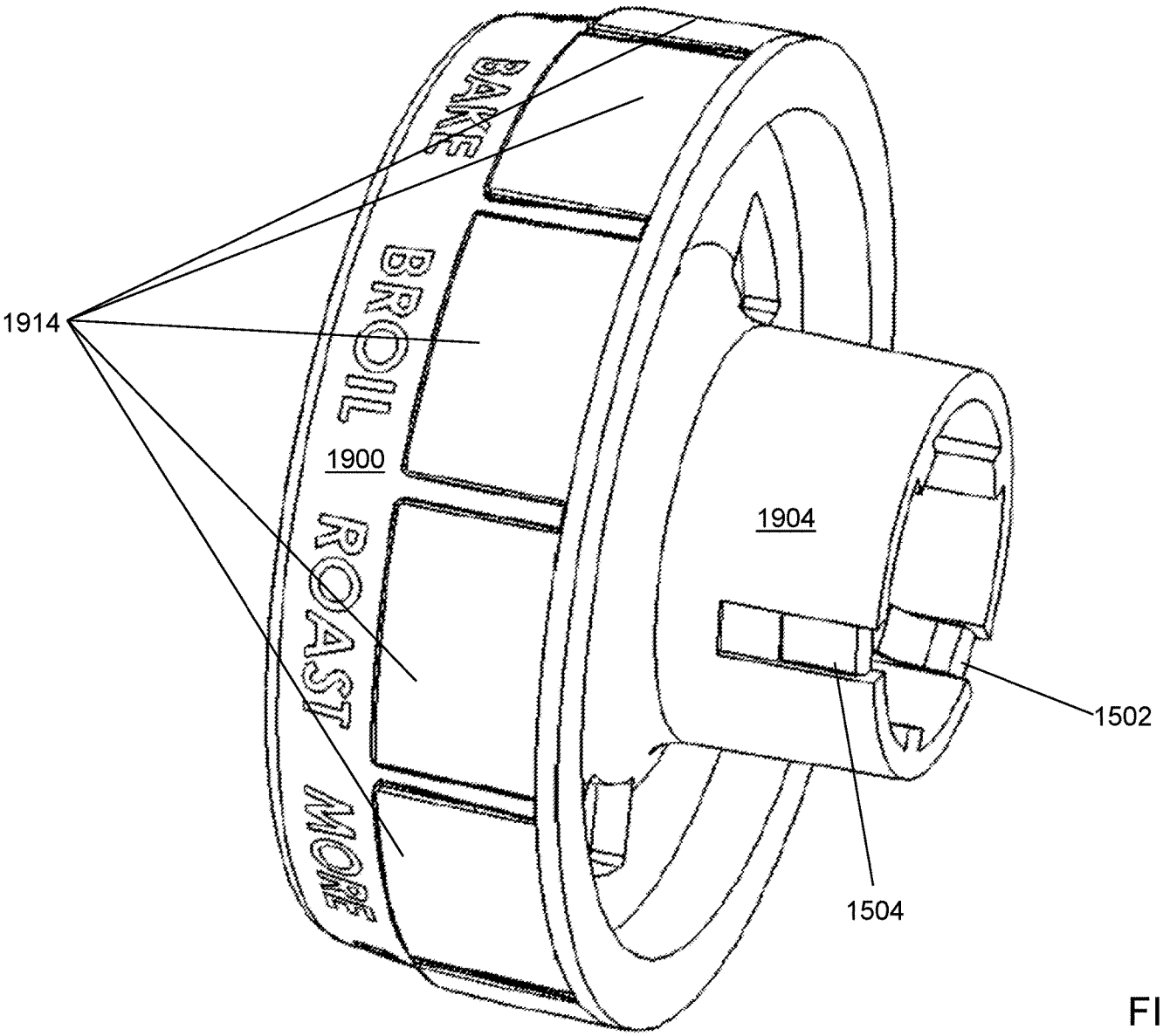
FIG. 19C depicts a back perspective view of the mode bezel of FIG. 19A in accordance with an illustrative embodiment.

Referring to FIG. 19A, a front perspective view of mode bezel 104 is shown in accordance with an illustrative embodiment. Referring to FIG. 19B, a front view of mode bezel 104 is shown in accordance with an illustrative embodiment. Referring to FIG. 19C, a back perspective view of mode bezel 104 is shown in accordance with an illustrative embodiment. Mode bezel 104 may include a bezel wall 1900, a bezel disc 1902, bezel cylinder 1904, the one or more bezel protrusions 1906, first tab slot 1908, and second tab slot 1910. Control knob 102 fits within bezel wall 1900 and can freely rotate without movement of mode bezel 104. Mode bezel 104 can freely rotate without movement of control knob 102 though the mode selection may affect what information is presented in display 204 based on operational settings defined by the control system of the device. A plurality of aperture walls 1912 may be formed through bezel disc 1902 to provide air flow. A fewer or a greater number of apertures walls of various shapes and sizes may be formed through bezel disc 1902 to provide a desired air flow. A plurality of pads 1914 may be formed on an outer surface of bezel wall 1900 to provide a grip feature for a user to easily rotate mode bezel 104. A fewer or a greater number of pads of various shapes, sizes, and materials may be formed on bezel wall 1900 to provide a desired grip feature.

Operational modes provided by the device to which control knob 102 and mode bezel 104 are mounted may be formed on an exterior of bezel wall 1900, for example, by printing, etching, etc. so that they are visible for selection by a user by rotating mode bezel 104. For example, when control knob 102 and mode bezel 104 are mounted to the oven, possible modes include off, bake, broil, roast, clean, convection, warm, sabbath, gourmet, dehydrate, stone mode, etc. A fan symbol adjacent a term may indicate a convection type for that mode. For example, a fan symbol next to the term "roast" may indicate a convection roast mode. The mode names may be icons/symbols in an alternative embodiment.

Bezel disc 1902 is formed across an interior of bezel wall 1900. Bezel cylinder 1904 is formed to extend from a center of bezel disc 1902 and defines an aperture that fits around an exterior of bezel socket cylinder 1800 when mode bezel 104 is mounted to bezel socket 1500. First spring clip 1502 is slid onto an edge of first tab slot 1908 of bezel cylinder 1904, and second spring clip 1504 is slid onto an edge of second tab slot 1910. The one or more bezel protrusions 1906 of bezel cylinder 1904 are aligned with the one or more alignment grooves 1804 of bezel socket cylinder 1800, first tab slot 1908 is aligned with first spring groove 1806 of bezel socket cylinder 1800, and second tab slot 1910 is aligned with second spring groove 1808 of bezel socket cylinder 1800. Mode bezel 104 is slid onto bezel socket 1500 to mount mode bezel 104 to the device. First spring clip 1502 and second spring clip 1504 mounted in first tab slot 1908 and second tab slot 191, respectively, and first spring groove 1806 and second spring groove 1808 are sized and shaped to create a push on/pull off force.

As used herein, the term "mount" includes join, unite, connect, couple, associate, insert, hang, hold, affix, attach, fasten, bind, paste, secure, hinge, bolt, screw, rivet, solder, weld, glue, form over, form in, layer, mold, rest on, rest against, abut, and other like terms. The phrases "mounted on", "mounted to", and equivalent phrases indicate any interior or exterior portion of the element referenced. These phrases also encompass direct mounting (in which the referenced elements are in direct contact) and indirect mounting (in which the referenced elements are not in direct contact, but are connected through an intermediate element) unless specified otherwise. Elements referenced as mounted to each other herein may further be integrally formed together, for example, using a molding or thermoforming process as understood by a person of skill in the art. As a result, elements described herein as being mounted to each other need not be discrete structural elements unless specified otherwise. The elements may be mounted permanently, removably, or releasably unless specified otherwise.

Use of directional terms, such as top, bottom, right, left, front, back, upper, lower, horizontal, vertical, behind, etc. are merely intended to facilitate reference to the various surfaces of the described structures relative to the orientations introduced in the drawings and are not intended to be limiting in any manner unless otherwise indicated.

The word "illustrative" is used herein to mean serving as an example, instance, or illustration. Any aspect or design described herein as "illustrative" is not necessarily to be construed as illustrative or advantageous over other aspects or designs. Further, for the purposes of this disclosure and unless otherwise specified, "a" or "an" means "one or more". Still further, using "and" or "or" in the detailed description is intended to include "and/or" unless specifically indicated otherwise.

The foregoing description of illustrative embodiments of the disclosed subject matter has been presented for purposes of illustration and of description. It is not intended to be exhaustive or to limit the disclosed subject matter to the precise form disclosed, and modifications and variations are possible in light of the above teachings or may be acquired from practice of the disclosed subject matter. The embodiments were chosen and described in order to explain the principles of the disclosed subject matter and as practical applications of the disclosed subject matter to enable one skilled in the art to utilize the disclosed subject matter in various embodiments and with various modifications as suited to the particular use contemplated.

What is claimed is:

1. A control knob comprising:

a control rod assembly configured to control an operation of a device, the control rod assembly comprising a base plate;

a control rod mounted to the base plate and configured to mount to the device; and an electronic circuit board mounted to the base plate and connected to receive an electrical signal from the control rod;

a display connected to receive an electrical signal from the electronic circuit board, the display comprising a display housing; and a display front face mounted to the display housing and configured to display a device status when an operation of the device is controlled by the control knob;

a knob mounted to the base plate, the knob comprising a knob aperture wall; and a cover mounted between the knob and the base plate, the cover comprising a cover sidewall configured to mount to the base plate;

a cover front wall mounted to the cover sidewall to cover an interior of the cover sidewall; and a display aperture wall formed in a portion of the cover sidewall and a portion of the cover front wall, the portion of the cover front wall configured to allow insertion of the display housing and the portion of the cover sidewall configured to allow viewing of the display front face therethrough;

wherein the control rod assembly, the display, and the cover are configured to rotate with the knob when the knob is rotated, wherein the display front face is visible through the knob aperture wall.

2. The control knob of claim 1, wherein the cover further comprises a plurality of tab aperture walls formed in the cover sidewall, wherein the base plate further comprises a plurality of tabs, wherein the plurality of tabs align with the plurality of tab aperture walls to mount the cover to the base plate when the cover is mounted to the base plate.

3. The control knob of claim 1, wherein the cover further comprises a plurality of tabs, wherein the base plate further comprises a plurality of tab aperture walls formed in the base plate, wherein the plurality of tabs align with the plurality of tab aperture walls to mount the cover to the base plate when the cover is mounted to the base plate.

4. The control knob of claim 1, wherein the cover further comprises a first alignment wall formed in the cover sidewall, wherein the base plate further comprises a second alignment wall that protrudes from the base plate, wherein the second alignment wall fits within the first alignment wall to align the cover with the base plate when the cover is mounted to the base plate.

5. The control knob of claim 1, wherein the cover further comprises a first alignment wall that protrudes from the cover sidewall, wherein the base plate further comprises a second alignment wall formed in the base plate, wherein the first alignment wall fits within the second alignment wall to align the cover with the base plate when the cover is mounted to the base plate.

6. The control knob of claim 1, further comprising a removable fastener, wherein the base plate further comprises a first fastener aperture wall formed through the base plate, wherein the cover further comprises a second fastener aperture wall formed through the cover front wall, wherein the knob further comprises a third fastener aperture wall formed therein, wherein the removable fastener is inserted through the first fastener aperture wall, through the second fastener aperture wall, and into the third fastener aperture wall to mount the knob to the control rod assembly when the knob is mounted to the control rod assembly.

7. The control knob of claim 6, further comprising an o-ring mounted to surround the removable fastener between the first fastener aperture wall and the second fastener aperture wall.

8. The control knob of claim 6, wherein the cover further comprises a plurality of tab aperture walls formed in the cover sidewall, wherein the base plate further comprises a plurality of tabs, wherein the plurality of tabs align with the plurality of tab aperture walls to mount the cover to the base plate when the cover is mounted to the base plate.

9. The control knob of claim 1, further comprising a display cover mounted to the knob to cover the knob aperture wall.

10. The control knob of claim 9, wherein the cover further comprises a first abutment wall, wherein the display cover further includes a first transparent layer that abuts the first abutment wall when the knob is mounted to the cover.

11. The control knob of claim 10, wherein the knob further comprises a second abutment wall, wherein the display cover further includes a second transparent layer that abuts the second abutment wall when the display cover is mounted to the knob.

12. The control knob of claim 1, wherein the knob further comprises a circumferential ring wall, a left knob platform wall, a right knob platform wall, and a knob rib, wherein the knob rib extends upward from the left knob platform wall, the right knob platform wall, and a bottom portion of the circumferential ring wall, wherein the circumferential ring wall extends downward from the left knob platform wall and the right knob platform wall, wherein the knob aperture wall extends across a top portion of the knob rib and a majority of a top portion of the circumferential ring wall aligned with the top portion of the knob rib.

13. The control knob of claim 12, further comprising a display cover mounted to the knob to cover the knob aperture wall.

14. The control knob of claim 1, wherein the display front face includes an increase indicator and a decrease indicator, wherein the increase indicator includes a first light lit when a device status value indicated by the device status can be increased by rotating the knob, wherein the decrease indicator includes a second light lit when the device status value can be decreased by rotating the knob.

15. The control knob of claim 1, further comprising a mode bezel mounted between the base plate and a first wall of the device.

16. The control knob of claim 15, wherein the mode bezel is configured to be rotatable independent of the knob to select a mode of the operation of the device controlled by the control knob.

17. The control knob of claim 15, wherein the mode bezel comprises an exterior surface that indicates a plurality of modes selectable using the mode bezel based on rotation of the mode bezel.

18. The control knob of claim 15, wherein the mode bezel mounts to a socket with a spring clip.

19. A device comprising:

a housing comprising one or more walls;

a control knob mounted to a first wall of the one or more walls of the housing, the control knob comprising a control rod assembly configured to control an operation of the device, the control rod assembly comprising a base plate;

a control rod mounted to the base plate and configured to mount to an electronics package; and an electronic circuit board mounted to the base plate and connected to receive an electrical signal from the control rod;

a display connected to receive an electrical signal from the electronic circuit board, the display comprising a display housing; and a display front face mounted to the display housing and configured to display a device status when the operation of the device is controlled by the control knob;

a knob mounted to the base plate, the knob comprising a knob aperture wall; and a cover mounted between the knob and the base plate, the cover comprising a cover sidewall configured to mount to the base plate;

a cover front wall mounted to the cover sidewall to cover an interior of the cover sidewall; and a display aperture wall formed in a portion of the cover sidewall and a portion of the cover front wall, the portion of the cover front wall configured to allow insertion of the display housing and the portion of the cover sidewall configured to allow viewing of the display front face therethrough; and the electronics package configured to measure a rotation angle of the control knob and to provide selection information based on the measured rotation angle to a control system of the device, wherein the control rod assembly, the display, and the cover are configured to rotate with the knob when the knob is rotated, wherein the display front face is visible through the knob aperture wall.

20. An oven comprising:

a housing comprising one or more walls;

a heat source mounted to the housing and connected to provide heat to an interior of the housing; and a control knob mounted to a first wall of the one or more walls of the housing, the control knob comprising a control rod assembly configured to control an operation of the heat source, the control rod assembly comprising a base plate;

a control rod mounted to the base plate and configured to mount to an electronics package; and an electronic circuit board mounted to the base plate and connected to receive an electrical signal from the control rod;

a display connected to receive an electrical signal from the electronic circuit board, the display comprising a display housing; and a display front face mounted to the display housing and configured to display a device status when an operation of the oven is controlled by the control knob;

a knob mounted to the base plate, the knob comprising a knob aperture wall; and a cover mounted between the knob and the base plate, the cover comprising a cover sidewall configured to mount to the base plate;

a cover front wall mounted to the cover sidewall to cover an interior of the cover sidewall; and a display aperture wall formed in a portion of the cover sidewall and a portion of the cover front wall, the portion of the cover front wall configured to allow insertion of the display housing and the portion of the cover sidewall configured to allow viewing of the display front face therethrough; and the electronics package configured to measure a rotation angle of the control knob and to provide selection information based on the measured rotation angle to a control system of the oven, wherein the control rod assembly, the display, and the cover are configured to rotate with the knob when the knob is rotated, wherein the display front face is visible through the knob aperture wall.

* * * * *